US007889129B2

(12) United States Patent
Fox et al.

(10) Patent No.: US 7,889,129 B2
(45) Date of Patent: Feb. 15, 2011

(54) LIGHTWEIGHT SPACE-FED ACTIVE PHASED ARRAY ANTENNA SYSTEM

(75) Inventors: Peter A. Fox, Burnaby (CA); Kenneth V. James, Vancouver (CA)

(73) Assignee: MacDonald, Dettwiler and Associates Ltd., Richmond (CA)

( * ) Notice: Subject to any disclaimer, the term of this patent is extended or adjusted under 35 U.S.C. 154(b) by 432 days.

(21) Appl. No.: 11/912,585

(22) PCT Filed: Jun. 9, 2006

(86) PCT No.: PCT/CA2006/000960

§ 371 (c)(1),
(2), (4) Date: May 7, 2008

(87) PCT Pub. No.: WO2006/130993

PCT Pub. Date: Dec. 14, 2006

(65) Prior Publication Data

US 2009/0009391 A1 Jan. 8, 2009

Related U.S. Application Data

(60) Provisional application No. 60/689,473, filed on Jun. 9, 2005.

(51) Int. Cl.
*H01Q 3/00* (2006.01)

(52) U.S. Cl. ..... 342/376; 342/354

(58) Field of Classification Search ..... 342/352, 342/354, 372, 376–377, 25 R, 25 A
See application file for complete search history.

(56) References Cited

U.S. PATENT DOCUMENTS 4,053,895 A 10/1977 Malagisi
4,163,235 A 7/1979 Schultz
4,308,539 A 12/1981 Birch
4,983,982 A 1/1991 Roberge
5,027,125 A 6/1991 Tang
5,283,587 A 2/1994 Hirshfield et al.

(Continued)

FOREIGN PATENT DOCUMENTS

EP 0618641 A2 10/1994

(Continued)

OTHER PUBLICATIONS

Wing. (2007). In The American Heritage® Dictionary of the English Language. Retrieved from http://www.credoreference.com/entry/hmdictenglang/wing.*

(Continued)

*Primary Examiner*—Thomas H Tarcza
*Assistant Examiner*—Fred H Mull
(74) *Attorney, Agent, or Firm*—Perkins Coie LLP

(57) ABSTRACT

A system for a satellite includes a core system and multiple nodes for generating an active phased array. Each node includes a transceiver for wirelessly receiving a transmit signal from the core system, for wirelessly transmitting the transmit signals to a target, for wirelessly receiving the receive signals from the target, and for wirelessly transmitting the receive signal back to the core system. The system also includes a subsystem for inhibiting signal interference between the transmit and receive signals. Each of the nodes may also include local power generation circuitry.

17 Claims, 19 Drawing Sheets

U.S. PATENT DOCUMENTS 5,313,221 A 5/1994 Denton, Jr.
5,333,000 A 7/1994 Hietala et al.
5,365,239 A 11/1994 Stilwell, Jr.
H1383 H 12/1994 Kaplan et al.
5,389,939 A 2/1995 Tang et al.
5,504,493 A 4/1996 Hirshfield
5,512,906 A 4/1996 Speciale
5,533,011 A * 7/1996 Dean et al. ..... 370/342
5,623,270 A 4/1997 Kempkes et al.
5,641,135 A 6/1997 Stuart et al.
5,854,607 A 12/1998 Kinghorn et al.
5,977,910 A 11/1999 Matthews
6,020,850 A 2/2000 Ji et al.
6,169,513 B1 1/2001 Cohen
6,172,642 B1 1/2001 DiDomenico et al.
6,201,508 B1 3/2001 Metzen et al.
6,208,287 B1 3/2001 Sikina et al.
6,252,542 B1 6/2001 Sikina et al.
6,297,774 B1 10/2001 Chung
6,297,775 B1 10/2001 Haws et al.
6,300,906 B1 10/2001 Rawnick et al.
6,344,830 B1 2/2002 Taylor
6,351,247 B1 2/2002 Linstrom et al.
6,356,240 B1 3/2002 Taylor
6,366,244 B1 4/2002 Fernandes
6,380,908 B1 4/2002 Andrews et al.
6,400,237 B1 6/2002 Seino et al.
6,421,021 B1 7/2002 Rupp et al.
6,448,937 B1 9/2002 Aiken et al.
6,522,293 B2 2/2003 Vail et al.
6,535,168 B1 3/2003 Marumoto et al.
6,556,168 B1 4/2003 Marumoto et al.
6,559,798 B1 5/2003 Marumoto et al.
6,567,040 B1 5/2003 Sevaston
6,573,863 B2 6/2003 Vail et al.
6,587,077 B2 7/2003 Vail et al.
6,598,009 B2 7/2003 Yang
6,628,235 B2 9/2003 Wight
6,650,291 B1 11/2003 West et al.
6,686,885 B1 2/2004 Barkdoll et al.
6,693,590 B1 2/2004 Toplicar et al.
6,714,163 B2 3/2004 Navarro et al.
6,737,938 B2 5/2004 Kitamori et al.
6,806,845 B2 10/2004 Fund et al.
6,861,975 B1 3/2005 Coleman Jr. et al.
6,891,497 B2 5/2005 Coleman, Jr. et al.
6,901,123 B2 5/2005 England
6,906,679 B2 6/2005 Kneisel et al.
6,958,738 B1 10/2005 Durham et al.
6,965,349 B2 11/2005 Livingston et al.
6,965,355 B1 11/2005 Durham et al.
6,975,268 B2 12/2005 Coleman et al.
6,977,623 B2 12/2005 Durham et al.
7,129,908 B2 10/2006 Edward et al.
2001/0033248 A1 * 10/2001 Owechko ..... 342/371
2001/0050632 A1 12/2001 Kawanabe
2004/0102157 A1 * 5/2004 Lewis ..... 455/63.4

FOREIGN PATENT DOCUMENTS

WO WO 03/107479 A1 12/2003

OTHER PUBLICATIONS

Wing. (1992). In Academic Press Dictionary of Science and Technology. Retrieved from http://www.credoreference.com/entry/apdst/wing.*

European Search Report, European Application No. 06752794.5, Applicant: MacDonald, Dettwiler and Associates, Ltd, mailed Jun. 9, 2009, 7 pages.

Hightower et al., "A Space-Fed Phased Array for Surveillance from Space," IEEE Proceedings of the National Radar Conference, 1991, 5 pages.

Dandekar et al. "Smart Antenna Array Calibration Procedure Including Amplitude and Phase Mismatch and Mutual Coupling Effects," 2000 IEEE International Conference on Personal Wireless Communications, 5 pgs.

Prieto et al., "Active Compensation Techniques for Spacecraft Antennas, Part 2—Measurement and Correction of Distortion," http://esapub.esrin.esa.it/pff/pffv5n2/garcia.htm, 3 pgs [accessed Jan. 9, 2006].

Mandl et al., "Optimizing Satellite Communications with Adaptive and Phased Array Antennas," GSAW, 2004, 16 pgs.

Breinbjerg, Olav, "Smart Antennas in Future Synthetic Aperture Radars,"http://www.cs.virginia.edu/~1b9xk/rfid/radar/Smart%20Antennas%20Radars.htm, Jun. 1998, 4 pages.

Fenn et al., "The Development of Phased-Array Radar Technology," Lincoln Laboratory Journal, vol. 12, No. 2, 2000, pp. 321-340.

Grace et al., "Active Lens: A Mass, Volume, and Energy Efficient Antenna for Space-Based Radar," Proceedings of the 2004 IEEE Radar Conference, Published Apr. 2004, 6 pgs.

* cited by examiner

LIGHTWEIGHT SPACE-FED ACTIVE PHASED ARRAY ANTENNA SYSTEM

CROSS-REFERENCE TO RELATED APPLICATION(S)

This application is a U.S. National Phase application of PCT/CA2006/000960, filed Jun. 9, 2006, which claims the benefit of U.S. Provisional Patent Application No. 60/689,473, filed Jun. 9, 2005, both of which are incorporated herein by reference.

BACKGROUND

A major advantage of phased array antennas is their ability to steer the beam electronically, eliminating the need for mechanical pointing and alignment. Another benefit is that the beam steering can be performed quickly, which allows tracking of rapidly moving targets, and tracking of multiple targets. The rapid beam steering also facilitates applications where an antenna on a moving platform (e.g. a ship at sea) it to maintain contact with a fixed entity such as a communications or broadcast satellite.

A common application of phased array antennas is in the implementation of radar systems, especially synthetic aperture radar systems.

Radio detection and ranging, or radar as it is commonly known, has been in existence since World War II and is used for a wide variety of applications. For example, radars are used for tracking the position of objects such as airplanes, ships and other vehicles or monitoring atmospheric conditions. Imaging radars have been developed for constructing images of terrain or objects.

Basic radar systems operate by transmitting a radio frequency signal, usually in the form of a short pulse at a target. A basic radar system is limited in both range resolution and azimuth resolution. Various techniques have been developed to overcome the limitations of a basic radar system. For example, to improve range resolution techniques such as pulse compression can be used.

To improve azimuth resolution without requiring an unacceptably large antenna, the Synthetic Aperture Radar technique has been developed. Synthetic Aperture Radars are now commonly used in both airborne and spaceborne (e.g. an airplane or satellite) based applications.

Modern Synthetic Aperture Radar systems require operational flexibility by supporting imaging over a wide range of resolutions and image swath widths. This operational flexibility requires the use of an active phased array antenna system.

Current active phased array systems for spaceborne applications suffer from a number of limitations, which restricts their broader use. The antennas are relatively large, on the order of 10 to 20 meters in length, and 1 to 2 meters in width. To preserve the quality of the beam and maintain it stable requires that the antenna itself be rigid and that it be rigidly supported to keep the antenna flat within the required tolerances. This results in an antenna with a high mass and requires support trusses or other mechanical means to provide the required stiffness when extended.

The size of the antenna generally prohibits launching the antennas in their operational configuration, as it is too large to fit within the available payload volume of the launch vehicle. The antenna is to be folded and stowed for launch, then deployed once in orbit. Complicated and expensive mechanisms to deploy the antenna and hold it rigid when deployed are to be specially designed. Special purpose mechanisms may also be designed and constructed to securely hold the antenna panels while stowed during launch and ensure that that the antenna is not damaged by the stresses incurred during launch. The high mass of the antenna makes the task of stowing and deploying it much more difficult.

The elements of the active phased array require a complex set of interconnections between the main bus structure and the antenna elements. Connections are needed for power, control, monitoring and distribution of radio-frequency signals for both transmit and receive. Complicated azimuth and elevation beam forming devices and interconnects are required. These interconnections further add to the overall mass, complexity and cost of the antenna. In addition, the interconnections may be made to bridge the hinges between the panels of the antenna adding to the manufacturing complexity and cost, and reducing the overall reliability.

The RADARSAT-2 spacecraft is an example of a state-of-the-art Synthetic Aperture Radar System using an active phased array antenna. The antenna in this instance is 15 meters in length and 1.5 meters in width. It consists of two wings, each containing 2 panels with each panel approximately 3.75 meters in length and 1.5 meters in width. Each panel contains 4 columns with each column containing 32 transmit/receive modules each with an associated sub-array with 20 radiating elements. A total of 512 transmit receive modules are used in the antenna. The overall mass of the antenna is approximately 785 kg. The extendible support structure required to deploy the antenna panels and maintain them in place has a mass of approximately 120 kg. The mechanisms used to hold the antenna while stowed, and then release it for deployment, add an additional approximately 120 kg of mass. The total mass required by the antenna is approximately 1025 kg. This large mass in turn drives the design of the spacecraft bus structure and attitude control systems, resulting in a larger, heavier spacecraft.

The large mass and complex design mean that the overall cost of designing, building and launching this class of spacecraft is high. This restricts the use of this technology to specialized applications and limits the number of spacecraft that can be launched, reducing the frequency of observation and limiting the operational missions that can be supported.

BRIEF DESCRIPTION OF THE DRAWINGS

In the drawings closely related figures have the same number but different alphabetic suffixes.

DRAWINGS

Reference Numerals

Figure 1:
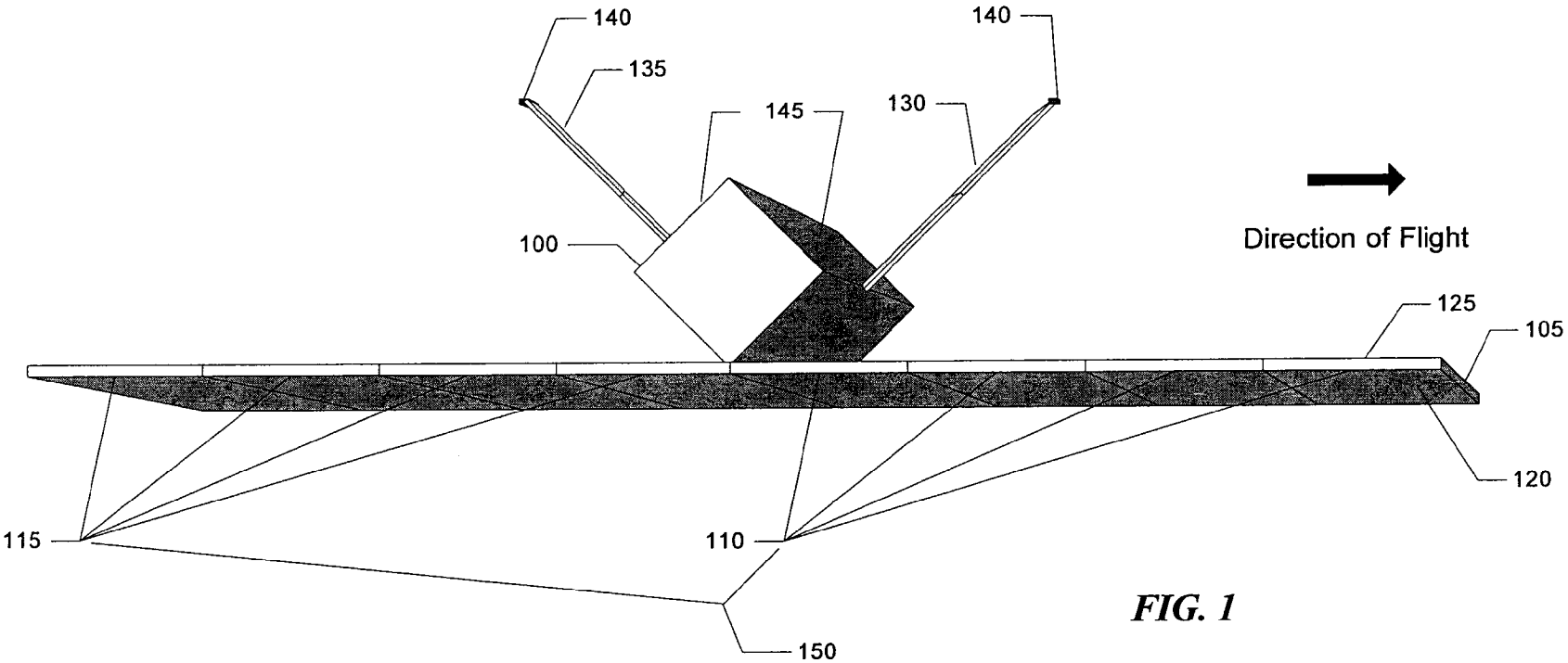
FIG. 1 shows an overall view of one spacecraft configuration.

100 spacecraft bus structure
105 antenna panel
110 antenna fore wing consisting of one or more antenna panels (four panels are shown in this example)
115 antenna aft wing consisting of one or more antenna panels (four panels are shown in this example)
120 radiating face of antenna panel
125 rear face of antenna panel
130 fore boom
135 aft boom
140 boom antenna assembly
145 solar array (to provide bus power)
150 phased array antenna (comprised of the fore wing and aft wing)
200 equipment housed in the spacecraft bus structure
205 spacecraft bus systems (power, control, data handling, etc)
210 receiver/exciter
215 stable local oscillator
220 transmit pulse generator
225 receiver
230 signal extraction and encoding unit
235 broadcast stable local oscillator signal
240 two way link with frequency translated transmit and receive signals
245 2-wire CAN Bus control bus
250 boom mounted antenna for transmit and receive signal distribution
255 boom mounted antenna for distribution of the stable local oscillator reference frequency
260 control bus
265 baseband chirp signal
270 antenna controller
300 active antenna node
305 antenna node solar panel assembly
310 battery charge regulator
315 rechargeable battery
320 power supply and power switching assembly
325 antenna for receiving stable local oscillator reference frequency
330 reference frequency processing assembly
335 antenna for transmit/receive signal
340 transmitter assembly
345 receiver assembly
350 subarray
355 antenna node controller
360 micro-controller
365 digital-to-analog converter means
370 phase control signals
375 transmit gain control signal
380 receive gain control signal
385 transmit and receive signals from antenna
400 signal routing device (e.g. circulator, switch, coupler, etc)
405 variable gain amplifier
410 mixer
415 high power amplifier
420 signal routing device (e.g. circulator, switch, coupler, etc)
425 low noise amplifier
430 mixer
435 variable gain amplifier
440 low noise amplifier
445 frequency doubler
450 direct modulator
455 power divider
460 phase shifted reference frequency
500 node electronics module
505 solar cell array
510 waveguide slots
600 RF Transparent material (e.g. quartz honeycomb)
605 panel structure
610 bonded aluminum sheet (front face of antenna panel)
615 waveguide launcher to inject signal into waveguide
700 location of optical assembly and image processing unit
705 optical path for antenna wing images
710 optical path for boom images
715 illuminated targets on antenna panels (not all targets identified)
720 illuminated target on fore boom
725 illuminated target on aft boom
800 example illuminated target on antenna panel
1000 optical assembly
1005 apertures for fore and aft wings and fore and aft booms
1010 image of fore and aft wings and fore and aft booms
1015 combined image
1020 solid state imaging array
1025 image processing unit
1030 fore wing target illumination controllers
1035 aft wing target illumination controllers
1040 fore boom target illumination controller
1045 aft boom target illumination controller

1050 wing illumination control signals
1055 boom illumination control signals
1060 interface to antenna controller
1100 launch vehicle payload fairing
1200 spacecraft bus structure (alternative 1)
1205 solar cell array for bus power (alternative 1)
1210 spacecraft bus structure (alternative 2)
1215 solar cell array for bus power (alternative 2)
1220 spacecraft bus structure (alternative 3)
1225 solar cell array for bus power (alternative 3)
1230 deployable boom assembly
1400 CAN Bus timing and control message
1405 active antenna node transmit mode enable
1410 active antenna anode receive mode enable
1700 antenna
1702 signal routing device (e.g. circulator, switch, coupler, etc)
1074 variable gain amplifier
1706 mixer
1708 power divider
1710 high power amplifier (horizontal polarization)
1712 high power amplifier (vertical polarization)
1714 signal routing device (e.g. circulator, switch, coupler, etc)
1716 horizontally polarized feed assembly
1718 vertically polarized feed assembly
1720 subarray
1722 low noise amplifier
1724 mixer
1726 variable gain amplifier
1728 signal routing device (e.g. circulator, switch, coupler, etc)
1730 low noise amplifier
1732 mixer
1734 variable gain amplifier
1736 antenna
1738 antenna
1740 low noise amplifier
1742 power divider
1744 frequency doubler
1746 direct modulator
1748 direct modulator
1750 power divider
1752 phase control signal
1754 phase control signal
1756 phase shifted reference frequency (transmitter)
1758 phase shifted reference frequency (horizontal receive polarization)
1760 phase shifted reference frequency (vertical receive polarization)
1762 transmit polarization select signal
1764 transmit gain compensation signal
1766 receive gain control signal (horizontal polarization)
1768 receive gain control signal (vertical polarization)
1770 two way link with frequency translated transmit and receive signals
1772 one way link with frequency translated receive signal

DETAILED DESCRIPTION

Embodiments of the invention provide a method and system for constructing a spaceborne active phased array antenna system that retains operational capabilities of traditional phased array antenna systems, but at lower mass, lower manufacturing complexity and hence lower overall mission cost. A space feed distributes signals to active antenna nodes, active antenna nodes contain local power generation and storage capability, construction method producing lightweight antenna panels, and a compensation system measures and compensates for mechanical distortions in the antenna geometry.

Various embodiments of the invention will now be described. The following description provides specific details for a thorough understanding and enabling description of these embodiments. One skilled in the art will understand, however, that the invention may be practiced without many of these details. Additionally, some well-known structures or functions may not be shown or described in detail, so as to avoid unnecessarily obscuring the relevant description of the various embodiments The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this Detailed Description section.

FIG. 1 shows a configuration of a spacecraft using a lightweight space-fed active phased array antenna system. A phased array antenna 150 is comprised of multiple antenna panels 105. Each panel has a front surface referred to as a radiating face 120 for transmitting a signal towards a target, and receiving the return signal reflected from the target. A rear face 125 of each panel contains multiple active antenna nodes 300 that form the active phased array.

The antenna panels 105 are arranged into two groups, which will be referred to as wings. A leading wing 110, relative to the direction of flight of the spacecraft, is referred to as the fore wing. The other wing 115 is referred to as the aft wing.

A frequency translated signal to be transmitted is distributed to the fore wing active antenna nodes through a space feed arrangement using antenna 250 contained in a boom antenna assembly 140 mounted on a deployable boom 130. The signal for the aft wing is distributed using another boom antenna assembly 140 mounted on a similar deployable boom 135. The antennas located on the two boom antenna assemblies also receive frequency translated signals transmitted from active antenna nodes. The received frequency translated signal contains the return signal from the target received at the radiating face of the phased array antenna.

Each boom antenna assembly 140 also contains a second antenna 255. This second antenna is used to broadcast a stable reference frequency to each of the active antenna nodes.

In the depicted embodiment antennas 250 and 255 are patch antennas, however other types of antenna can also be used.

A bus structure 100 provides mechanical support for the active phased array antenna system. The bus contains within it systems commonly found on most spacecraft to perform functions including communications, attitude control, spacecraft monitoring and control, thermal control, data handling, propulsion, etc. Solar arrays 145 mounted on the sun facing surfaces of the bus structure provide power for all parts of the spacecraft except active antenna nodes 300 that may provide their own power.

Figure 2A:
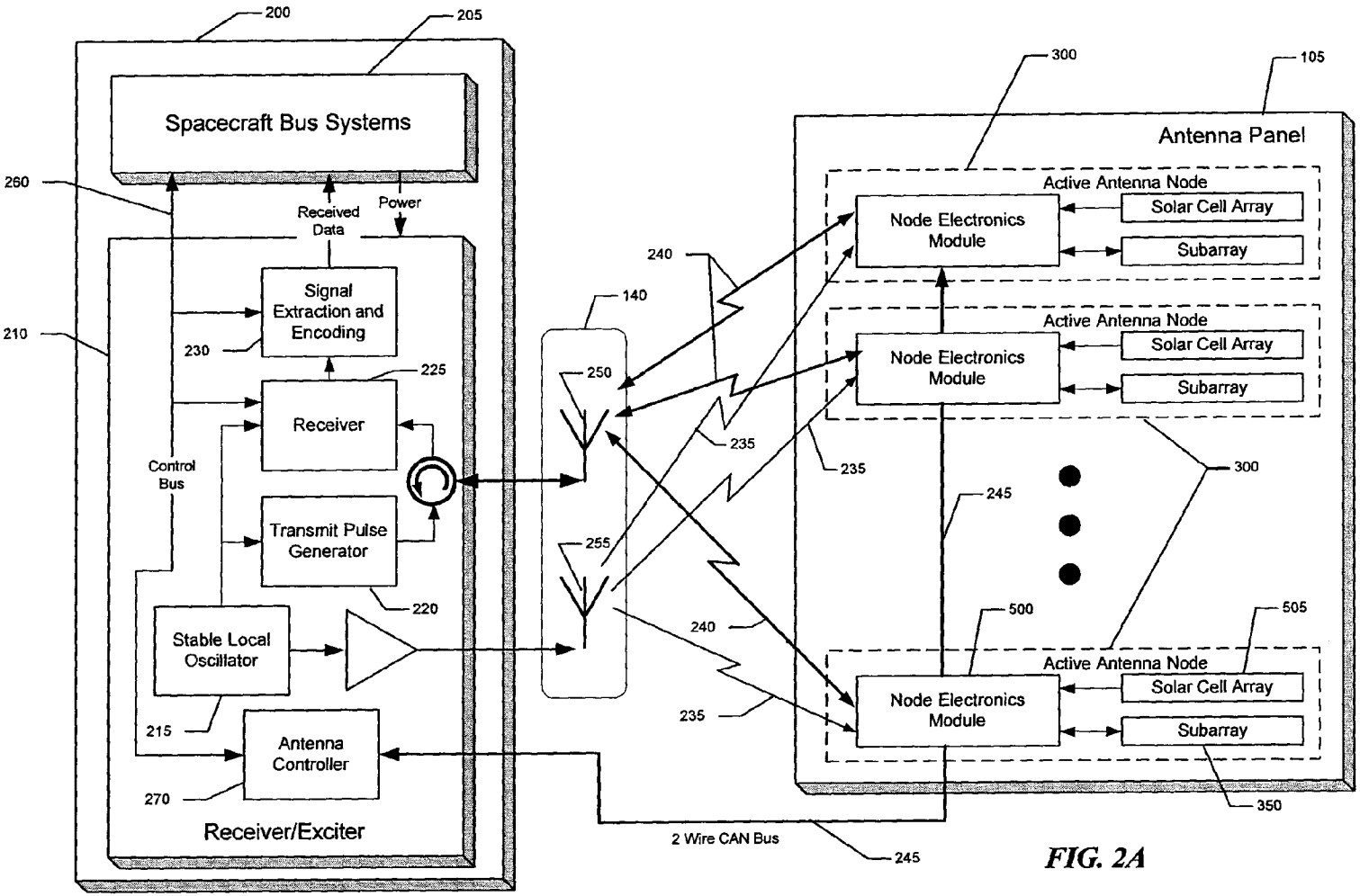
FIG. 2A shows a block diagram of an antenna system.

The block diagram of FIG. 2A shows major components of the active phase array antenna system and how they interact with each other. For simplicity only a single antenna panel of a single wing is shown. The other antenna panels are similar in construction and operation.

A receiver/exciter 210 is contained within the bus structure 100. The receiver/exciter generates a reference frequency and modulated transmit signals employed for the radar application. The receiver/exciter also receives a return signal from the panel and provides signal extraction and encoding functions to digitize and format received signal data.

The receiver/exciter interfaces to a spacecraft bus systems 205 to receive power for operation and to transfer received data. An antenna controller 270 in the receiver/exciter is connected to the main spacecraft bus processor through control bus 260 to permit control and monitoring of the antenna system. There are no special requirements for the control bus and it can be implemented using any one of several available technologies such as MIL STD 1553B or CAN Bus.

The antenna controller 270 provides control and monitoring of all units in the receiver/exciter and the active antenna nodes 300.

A stable local oscillator 215 generates a stable, un-modulated reference frequency. This reference frequency is distributed locally to a transmit pulse generator 220 and receiver 225 and is also broadcast to all of the active antenna nodes 300 using antenna 255 in boom antenna assemblies 140. A single stable local oscillator is used to drive both boom antenna assemblies through a simple power divider.

The transmit pulse generator 220 produces the waveform of the transmitted pulse. For radar systems this is usually a linearly modulated frequency pulse commonly known as a chirp. Techniques for generating this type of pulse are well known in the current art.

The chirp is transmitted 240 from the boom antenna assembly 140 to all active antenna nodes 300 in the corresponding wing. Within each active antenna node the chirp is received, converted to the operating frequency of the antenna, adjusted for phase and amplitude, amplified and transmitted from the radiating face of the antenna.

The active antenna nodes 300 receive the returned signal from the target and re-transmit this signal so that it can be received by the antenna 250 on the boom antenna assembly 140.

To avoid interference with other signals, the chirp and the received signals transmitted using the space-feed are converted to a separate carrier frequency according to a defined frequency plan to produce frequency translated versions of the original signals. As an example, a frequency plan for a typical SAR application would be as follows: SAR operating frequency of 5.400 GHz (C-band), stable local oscillator frequency of 2.400 GHz and carrier frequency for the frequency translated transmit chirp 240 and received signals 240 of 10.200 GHz (X-band). The description that follows assumes this example frequency plan.

Figure 2B:
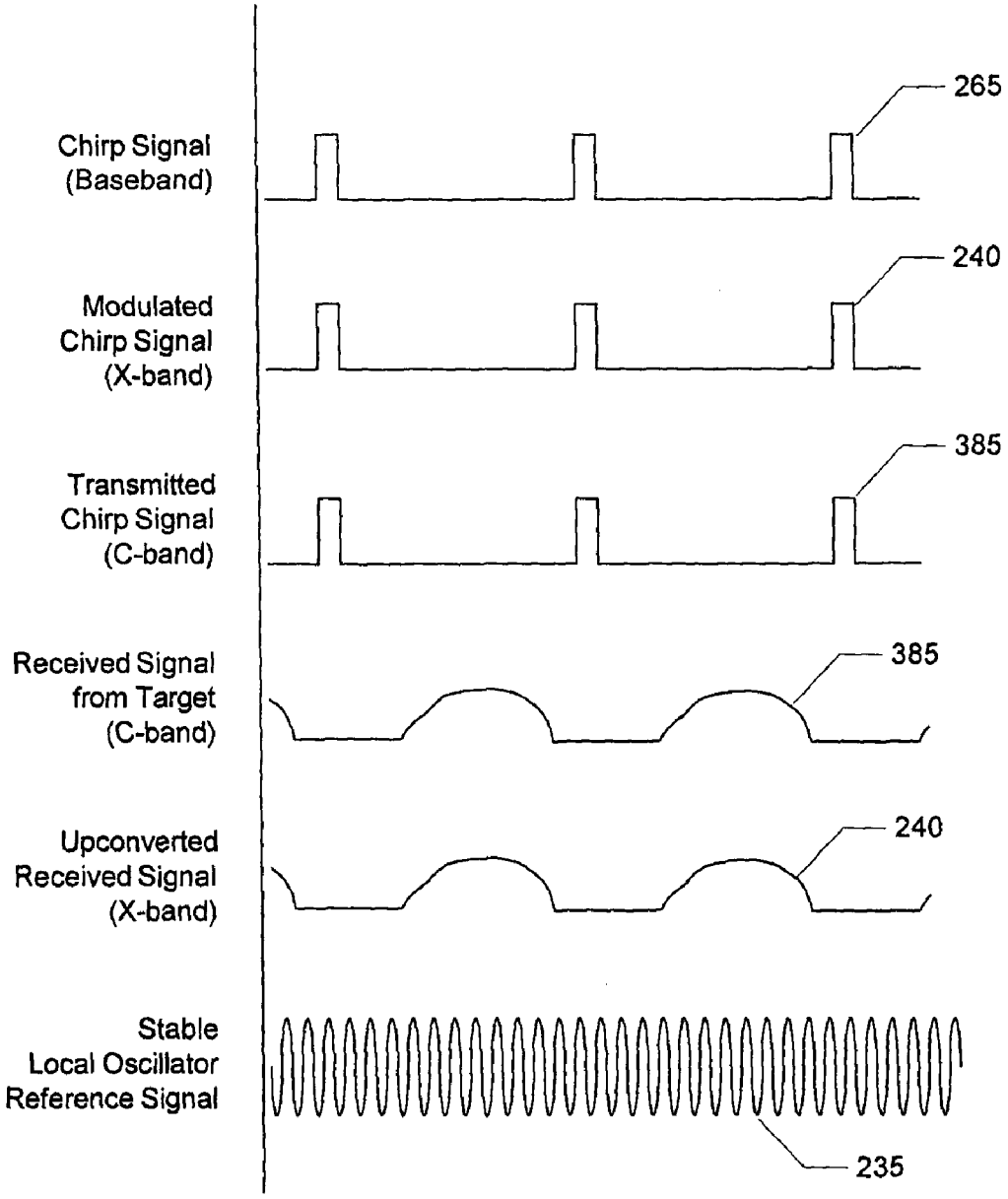
FIG. 2B shows a timing diagram for the antenna system.

FIG. 2B shows an example of a timing relationship between different signals. The stable local oscillator reference frequency is continuously broadcast 235 to each active antenna node. The transmit pulse generator 220 generates a baseband chirp signal 265 and a modulated chirp signal at X-band that is also broadcast 240 to all active antenna nodes. In the active antenna node, the X-band chirp signal is converted to C-band and is adjusted for phase prior to being transmitted 385 towards the target. The return signal 385 from the target is adjusted for phase and gain and is converted from C-band to X-band and transmitted 240 to the receiver 225. Gain adjustments 375 and 380 are used to compensate for space feed path differences. Gain adjustment 380 also provides antenna aperture apodization.

The receiver 225 receives the converted broadcast signal 240, demodulates it and forwards the baseband signal to the signal extraction and encoding unit 230. The signal is digitized, encoded and formatted and the resulting digital data is transferred to the spacecraft bus systems 205 for processing, storage and/or transmission to a ground based receiving terminal.

The phased array antenna 150 is comprised of multiple antenna panels 105. Each antenna panel contains multiple active antenna nodes 300 mounted on the rear surface 125 of the panel. As an example, an active phased array antenna for a synthetic aperture radar application would contain on the order of 8 antenna panels, with each panel containing on the order of 64 active antenna nodes, for a total of 512 active antenna nodes.

Figure 3:
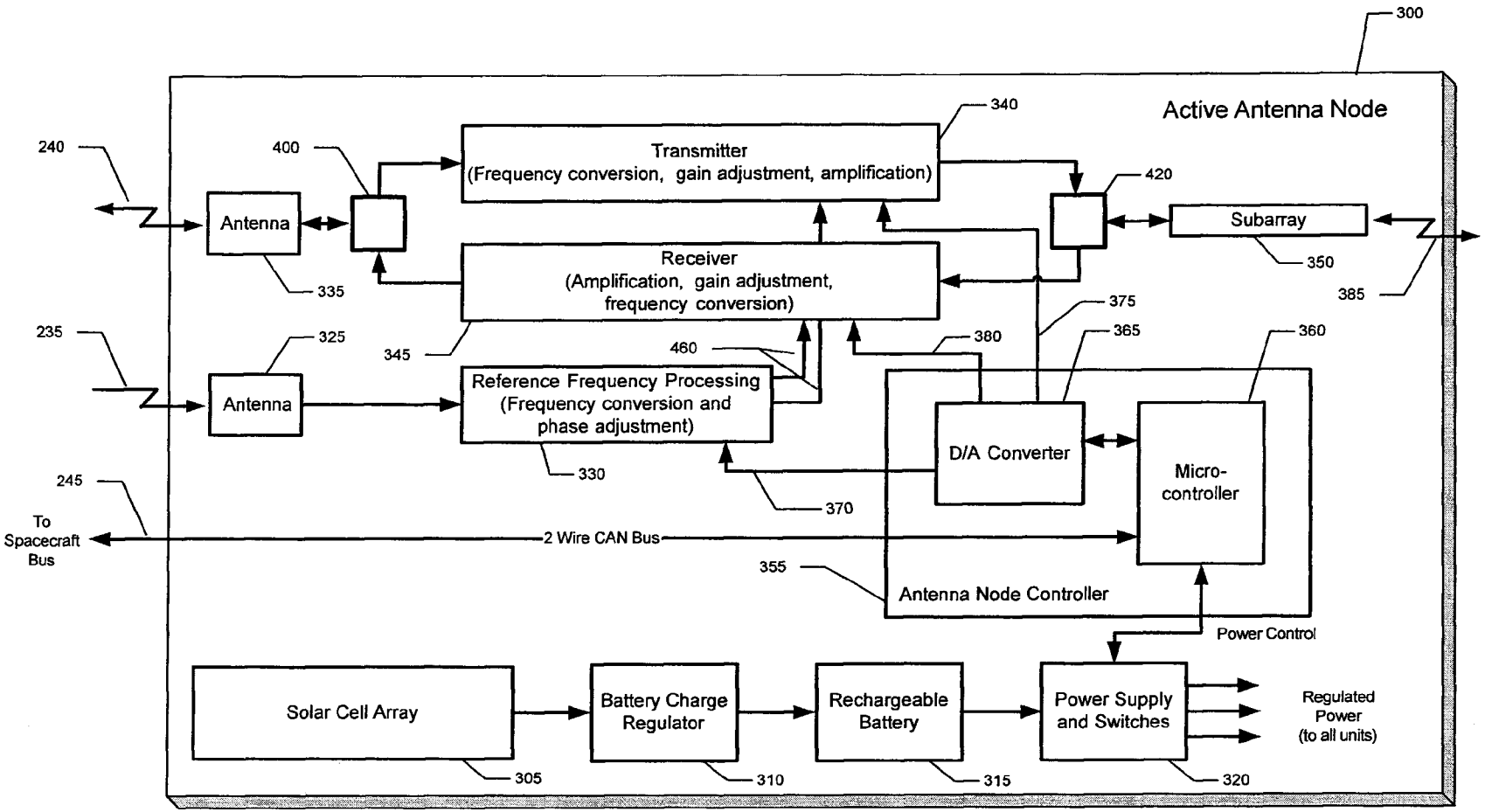
FIG. 3 shows a block diagram of an active antenna node.

FIG. 3 shows a block diagram of an active antenna node 300. The active antenna node contains its own local power generation and storage means to provide power to all its components. To provide power generation, a solar cell array 305 is mounted on the rear face of the antenna panel 125. In normal operation, the radiating face of the antenna panel 120 will be pointed at the earth at an angle of at least 30 degrees from nadir. At this spacecraft attitude, the solar cell arrays on the rear of the antenna panels will be exposed to the sun when the spacecraft is placed in an appropriate orbit such as a sun-synchronous, dawn-dusk orbit. The spacecraft can be slewed to better orient the solar panels towards the sun for more efficient solar power generation and battery charging. This can occur in periods that do not require operation of the antenna system, such as intervals where SAR imaging is not requested.

An integrated circuit battery charge regulator 310 regulates the power from the solar cell array 305 and charges a rechargeable battery 315. A regulated power supply with switching circuits 320 provides power to all other components of the active antenna node and allows elements of the active antenna node, for example the transmitter or receiver, to be independently powered on and off.

The RF components of the active antenna node consist of two antennas 325 and 335, reference frequency processing circuit 330, transmitter circuit 340, receiver circuit 345 and subarray 350. Operation of the RF components of the active antenna node is described in the discussion on FIG. 4 that follows.

In the depicted embodiment antennas 325 and 335 are patch antennas, however other types of antenna can also be used.

In the depicted embodiment, subarray 360 is a slotted waveguide subarray, however other arrangements could also be used. One example of an alternative arrangement is a subarray consisting of multiple patch, conformal or planar radiators bonded to the font or back surface of the antenna panel. If bonded to the back, the panel would be RF transparent; this alternative would provide simplicity and reduced mass in mounting and feeding the radiating subarray elements, while also providing structural support.

Control of the active antenna node can be achieved by using a microcontroller or other programmable logic element such as a field programmable gate array. The depicted embodiment uses a microcontroller 360 such as an Intel 8051 that incorporates a built-in CAN Bus interface. A two-wire CAN Bus interface connection 245 is used to provide control and timing signals from the antenna controller 270 to the active antenna node, and to monitor status of the node. Although an embodiment using a wireless interconnect for this interface could be used, some wiring may still be required to provide conductive paths to dissipate electro-static charge that could accumulate on the antenna panels. A wired bus is both easier to implement and can be used to dissipate this electro-static charge. The microcontroller drives a digital-to-analog converter 365 that generates analog control signals 380, 375, 370 used to control transmitter gain, receiver gain and phase (both transmit and receive) respectively.

Figure 4:
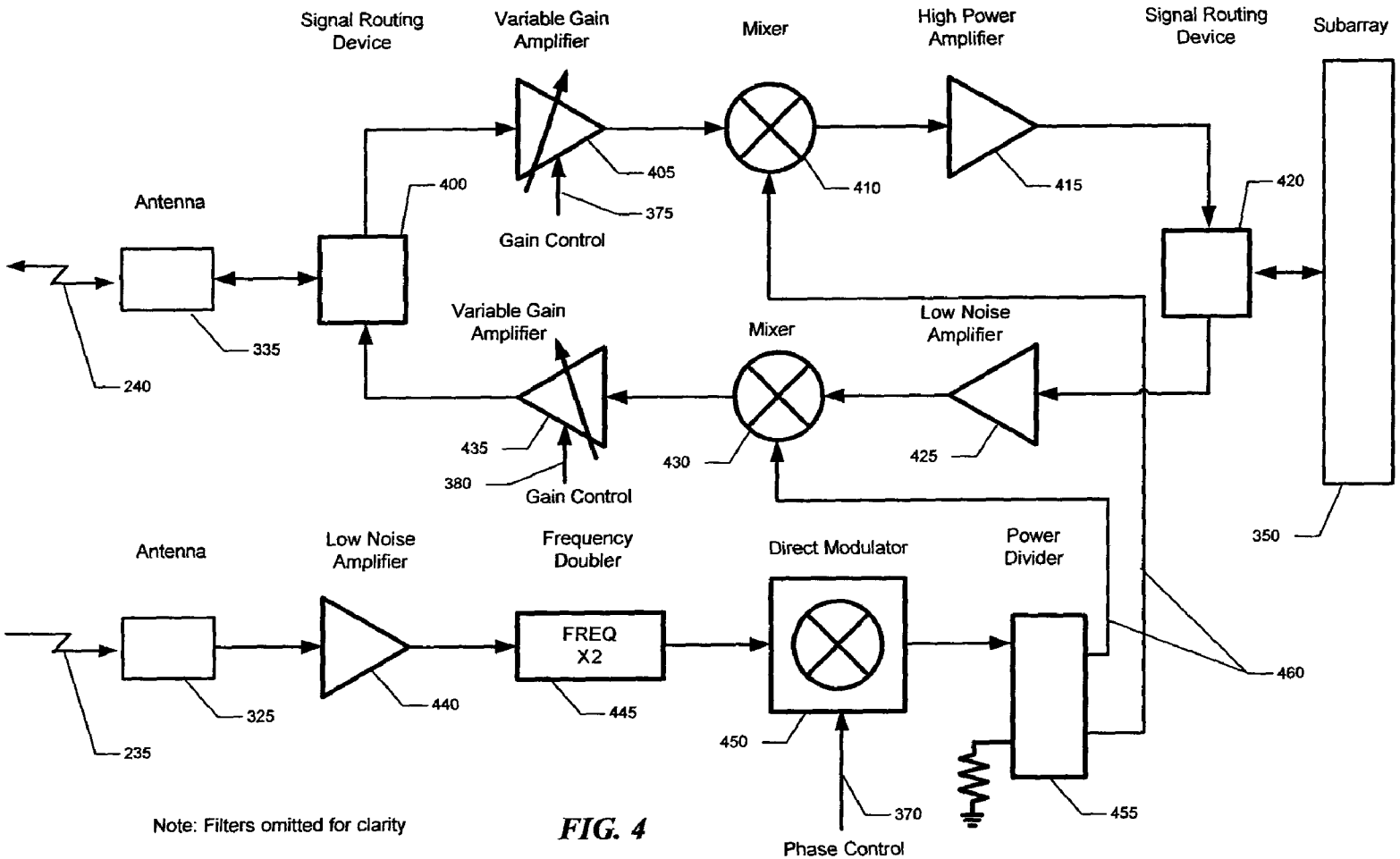
FIG. 4 shows a block diagram of radio frequency circuit functions contained within the active antenna node.

FIG. 4 shows RF circuits of an active antenna node. Note that filters have been omitted from the diagram to make it simpler. There are no extraordinary requirements for the filters and their use, design and construction is well understood in the current art. Antenna 325 receives the broadcast stable local oscillator signal 235. This signal is amplified by low noise amplifier 440 and then doubled in frequency using frequency doubler 445, although other frequency adjustment may be employed. Direct modulator 450 is used to adjust the phase of the signal based on phase control signal 370 from the digital to analog converter 365. The phase adjusted reference signal is divided using power divider 455 (or switch) and phase adjusted reference signals 460 are routed to both transmitter 340 and receiver 345 sections of the active antenna node. An alternative embodiment could use a phase shifter in place of direct modulator 450, or two modulators in lieu of the power divider.

The active antenna node receives the frequency translated chirp signal 240 using antenna 335. A signal routing device 400 routes the signal to variable gain amplifier 405 whose gain is set by the microcontroller through signal 375. Mixer 410 converts the signal to the operating frequency of the radar and phase adjusts the signal to form the beam. The signal is amplified using high power amplifier 415 and routed to subarray 350 through signal routing device 420.

Signals reflected from the target are received by subarray 350 and routed to the receiver portion of the active antenna node through signal routing device 420. Low noise amplifier 425 amplifies the signal. Mixer 430 upconverts the signal and adjusts the phase of the signal to form the receive beam. The signal is amplified and its gain adjusted by variable gain amplifier 435, whose gain is set by the microcontroller through signal 380. Signal routing device 400 routes the signal to antenna 335 for transmission to receiver 225 in the receiver/exciter 210.

An alternative embodiment could use a double or triple balanced mixer in place of either or both mixers 410 and 430.

To improve the signal to noise ratio for received signals, the beam pattern of the antenna is made narrower in elevation when in receive mode, resulting in an increased gain in this axis. To maintain coverage of the target area, the beam pattern is swept through the target area from near range to far range. The sweep is timed to point the beam in elevation to receive signals from targets at the near range edge at the start of the sweep, and targets at the far range edge at the end of the sweep. Microcontroller 360 controls the sweeping of the beam by using digital-to-analog converter means 365 to generate control signals 370 to adjust the phase of the received signal. This method of steering the beam during receive maintains the signal to noise ratio with lower transmitted power, allowing for fewer or lower power active antenna nodes to be used, further lowering mass and simplifying construction.

The active antenna node signals over the space feed should be isolated from the signals transmitted/received from the front face of the antenna panels to/from the target. Such isolation is required to prevent coupling of signals between these two radio frequency links. The embodiment described above uses frequency translation to achieve this isolation. (While in one embodiment such frequency isolation is performed at the nodes rather than the bus structure 100, an alternative embodiment could employ the reverse.) Other techniques may also be used to achieve this isolation or for inhibiting interference between signals. Possible techniques can include one or a combination of any of the following: electromagnetic shielding, use of different signal polarizations, use of digital signal processing techniques, use of differently coded spread spectrum channels, use of time domain multiplexing alone or in conjunction with local signal storage.

Figure 5A:
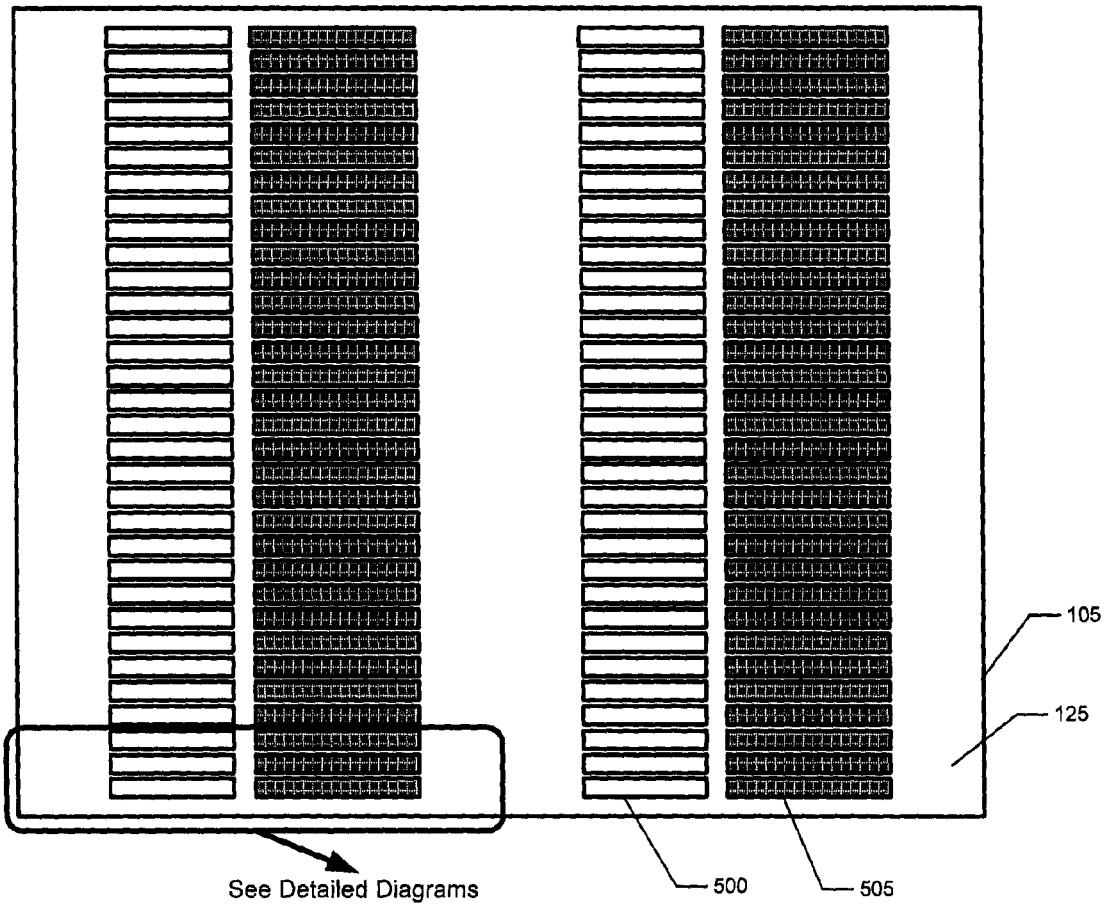
FIG. 5A shows the rear face of one antenna panel.

FIG. 5A shows an arrangement of active antenna nodes on the rear face 125 of an antenna panel 105. The number and arrangement of active antenna nodes can be adjusted to suit the needs of the intended application. The arrangement shown is typical for a synthetic aperture radar application. This example arrangement has a total of 64 active antenna nodes per antenna panel, arranged as two columns of 32 active antenna nodes per column. Alternative arrangements are also possible, for example a six panel antenna with a total of 384 active antenna nodes, with panel dimensions adjusted to provide the desired aperture size.

FIG. 5A also shows node electronics modules 500 and solar cell arrays 505 for each active antenna node.

Figure 5B:
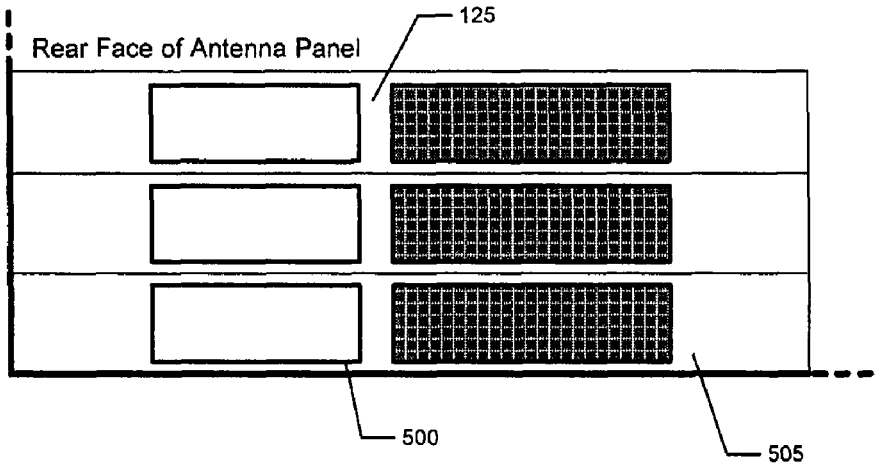
FIG. 5B shows a detailed view of a portion of the rear face of an antenna panel.

FIG. 5B shows a detailed view of a portion of the rear of the panel 125 with the node electronics module 500 and the solar cell array 505 identified.

Figure 5C:
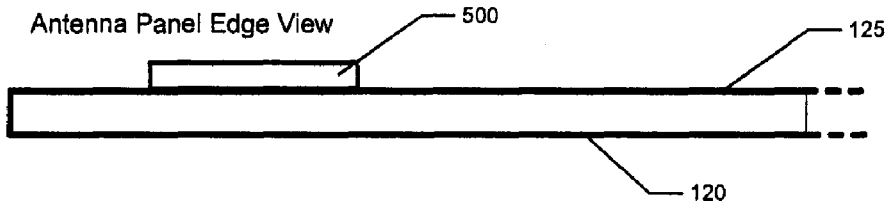
FIG. 5C shows a detailed view looking from the edge of a portion of the rear face of an antenna panel.

FIG. 5C shows the edge view of a portion of the antenna panel with the antenna panel radiating surface 120 and rear surface 125 of the antenna, and the node electronics module 500 identified.

Figure 5D:
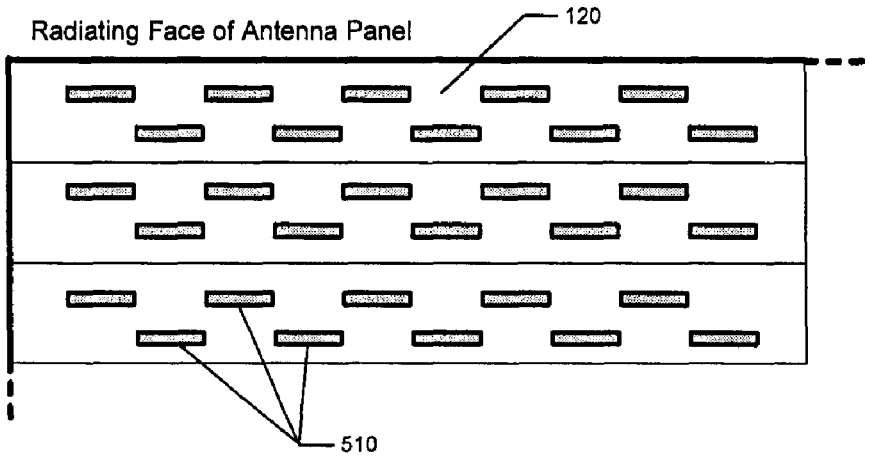
FIG. 5D shows a detailed view of a portion of the front (radiating) face of an antenna panel.

FIG. 5D shows the radiating face 120 of the antenna panel with slots 510 for a slotted waveguide subarray visible. The arrangement, size and number of slots is dependent on the operating frequency and operational requirements for the antenna and the means for determining these characteristics is well understood and documented in the prior art.

Figure 6A:
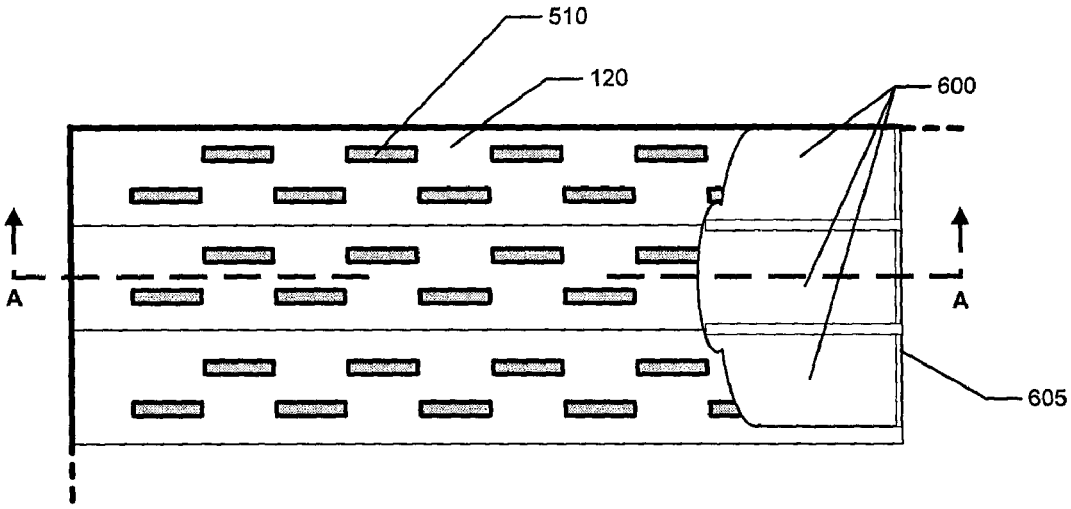
FIG. 6A shows a cut-away view of a portion of the front face of an antenna panel.

FIG. 6A shows a cutaway view of a portion of an antenna panel to illustrate construction of the slotted waveguide subarray. The antenna panel frame 605 is constructed out of conducting material such as aluminum or conductively plated non-conducting material such as carbon fiber to form the structures for supporting the node electronics modules 500 and to form the cavities for the slotted waveguide subarray. To provide structural support, the cavity of the slotted waveguide subarray may be filled with an RF transparent material 600 such as quartz honeycomb. The quartz honeycomb material is commercially available for space-qualified applications. Other RF transparent materials can also be used.

Figure 6B:
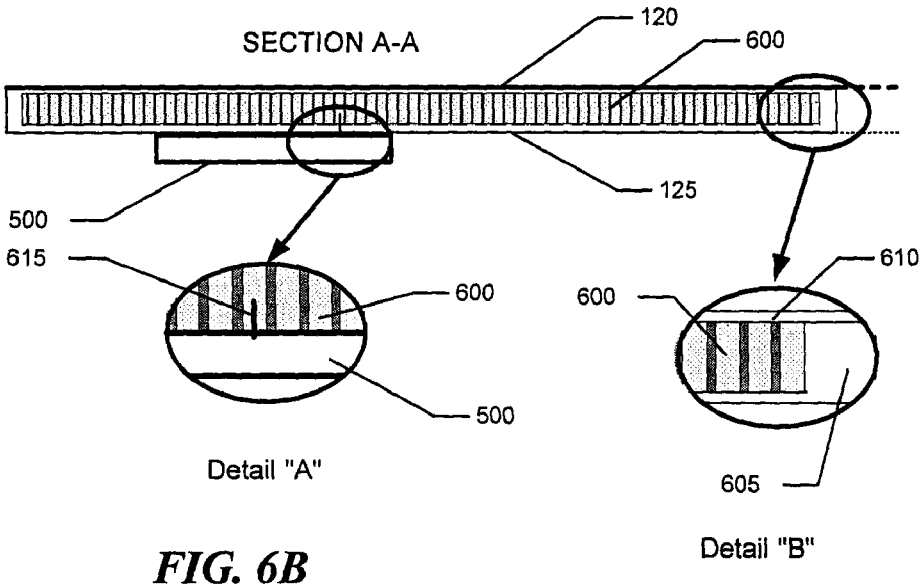
FIG. 6B shows a section view through a portion of an antenna panel.

FIG. 6B shows a section thorough the antenna panel. Detail "B" shows construction of the panel with antenna panel frame 605 and RF transparent material 600 identified. An aluminum sheet or conductively plated carbon fiber sheet 610 with slots 510 is bonded to the antenna frame and RF transparent material using a conductive adhesive, forming the radiating face of the antenna and providing structural strength. Detail "A" shows a portion of node electronics module 500 and waveguide launcher element 615 used to couple RF signals between the node electronics module and the slotted waveguide subarray.

Current active phased array antennas, such as the one used for the RADARSAT-2 mission have a mass on the order of 45 kg per square meter. The combination of constructing antenna panels as described, and the elimination of wiring harnesses for power and RF signal distribution result in the active phased array having a mass on the order of 5 kg per square meter.

The significant reduction in mass makes it possible to use technology developed by the space industry for the deployment of large solar arrays for spacecraft. This technology can be readily adapted to support and deploy the active phased array antenna. This technology is the lowest cost, most reliable way of deploying large apertures. Many companies have successfully built and deployed large solar arrays and the techniques used are fully qualified and have established heritage.

In the design and operation of the antenna, compensation is employed for effects introduced by the space feed arrangement. One effect is due to the non-uniform radiation pattern from the antennas on the booms and the active antenna nodes. Another effect is the variation in gain and phase due to the path length differences from the space feed antenna assemblies 140 and the active antenna nodes. This effect is a function of the antenna geometry.

The radiation patterns can be measured on the ground and compensation at each active antenna node can be computed. Compensation for the effects that are a function of the antenna geometry requires that the geometry be known while the antenna is operating. An ideal active phased array would have a front radiating surface that was planar and not subject to mechanical or thermal distortion. The antenna geometry would be constant and could be measured on the ground prior to launch, and necessary compensation at each active antenna node computed.

The disadvantage of using solar array technology is that it cannot achieve these ideal characteristics, as the deployed aperture is not stiff and can have mechanical and thermal distortions and oscillations. The expected deviation from ideal due to the distortions and oscillations are in the order of a few centimeters at frequencies of 0.1 Hz or less. This inherent limitation should be overcome by a means that provides geometry compensation of the antenna.

There are several possible approaches for implementing the geometry compensation means. For example, compensation can be implemented on-board the spacecraft to perform dynamic real-time compensation of antenna distortions. An alternative approach is to implement geometry compensation as a non real-time correction applied on the ground during processing of the acquired radar data. The selected approach depends on the size of the antenna aperture, the antenna dynamics and the application.

The depicted geometry compensation means uses an optical technique to take multiple images of illuminated targets mounted on the rear face of the antenna panels and on the fore and aft booms to perform dynamic real-time geometry compensation on-board the spacecraft.

Figure 7:
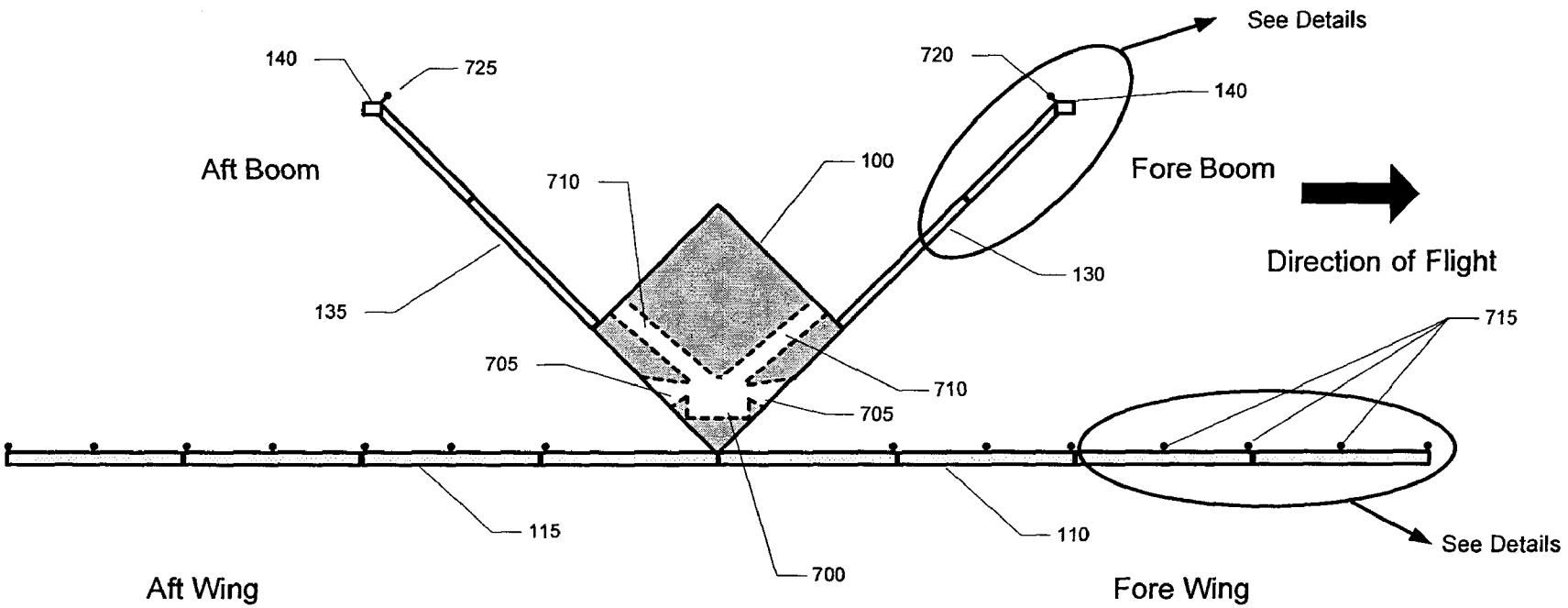
FIG. 7 shows targets used for a geometry compensation system and optical paths within a satellite bus for collecting images.

FIG. 7 gives an overview for dynamic geometry compensation of the active phase array antenna. A cavity 700 within the spacecraft bus structure 100 houses optical and electronics assemblies that comprise a dynamic compensation system. Optical paths 705 and 710 are provided from the optical assembly cavity to the fore and aft wings and to the fore and aft booms respectively. Targets 715, 720 and 725 are attached to the back of the antenna panel and to the ends of the fore boom and aft booms respectively. The targets contain an internal light source to illuminate the surface of the target facing in the direction of the optical path. The light source can be switched on and off under control of the dynamic geometry compensation system. The shape of the illuminated surface of the targets is selected to facilitate accurate determination of the center of the target's position in an image of the target. For example a circular shape sized so that the resulting image of the target will be multiple pixels wide allows techniques to locate the centroid of the target's image to be used to improve position determination. Distortion of the booms and antenna panels in the dimension along their respective lengths is small, and the impact of this distortion is negligible, and the geometry compensation means does not need to measure in this dimension. Distortions are more pronounced in the other two dimensions and their impact is significant. The optical path is arranged to achieve high accuracy in these two dimensions by imaging along the length of the structures being measured.

To further improve the ability to extract the targets from the imagery, the targets may use solid-state light sources with a narrow spectral bandwidth. Optical filters with the corresponding bandwidth are placed in the optical assembly to filter out light that falls outside the filter's bandwidth.

Figure 8A:
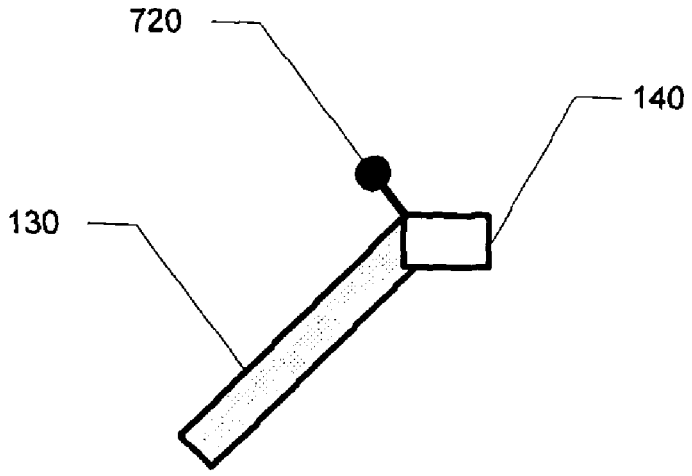
FIG. 8A shows a detailed view of a fore boom mounted illuminated target.
Figure 8B:
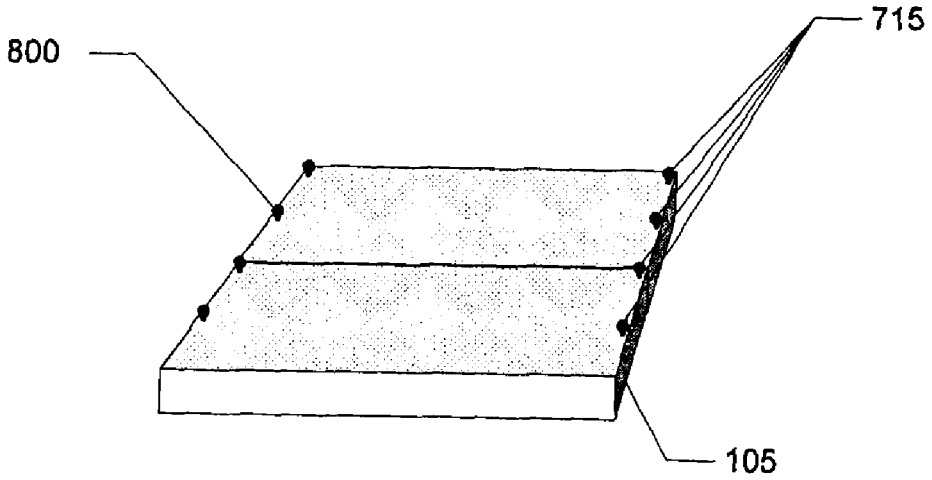
FIG. 8B shows an arrangement of illuminated targets on two antenna panels.
Figure 8C:
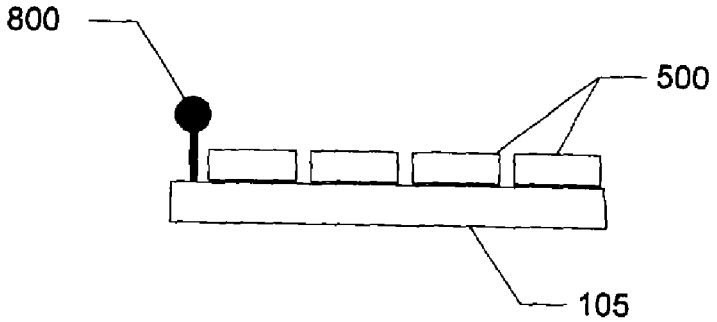
FIG. 8C shows a detail of one of the targets.
Figure 9:
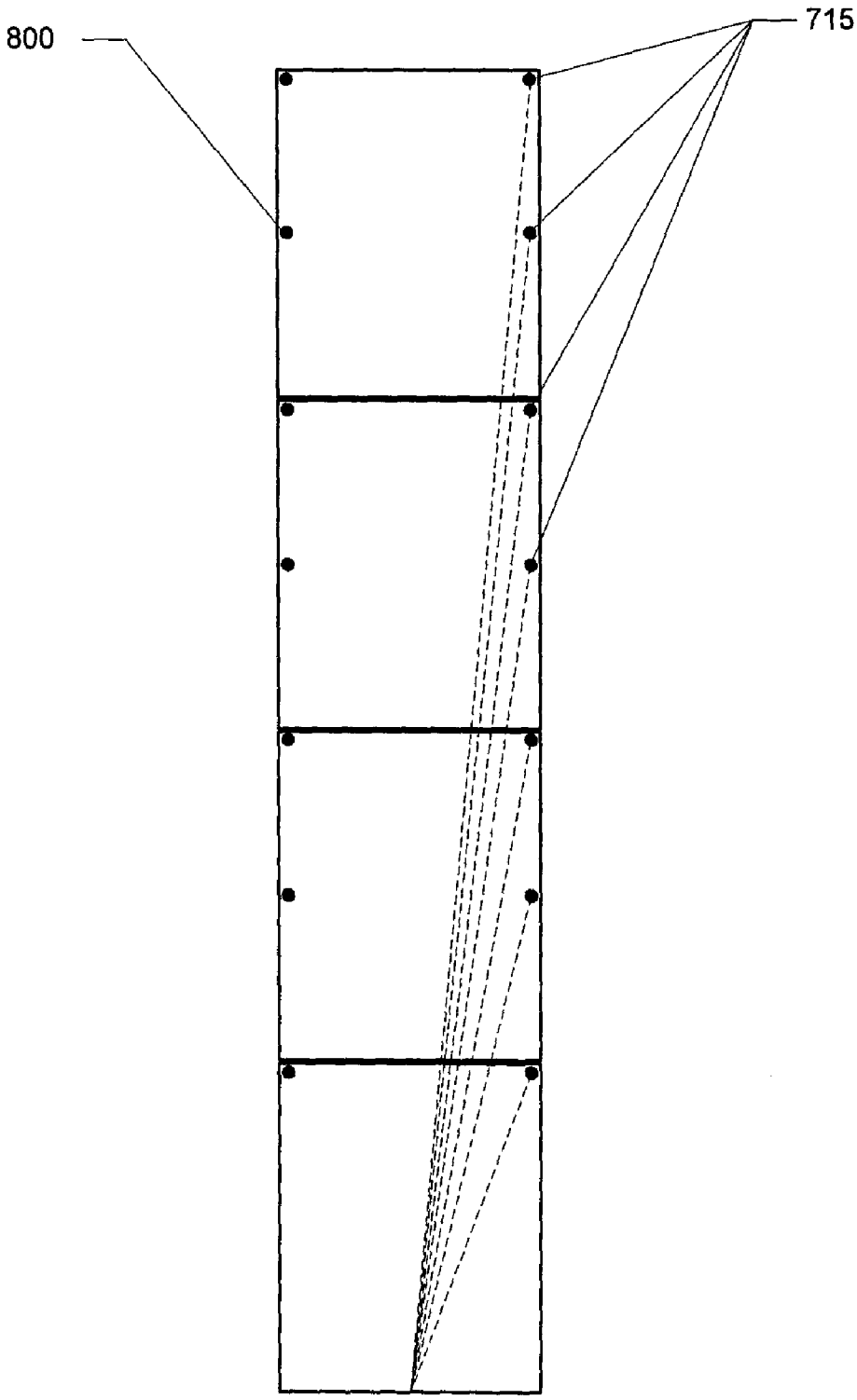
FIG. 9 shows a view of one wing, showing a location of targets on the antenna panels. It shows the view observed by the imaging system (bottom of figure) and arrangement of targets such that nearer targets do not obstruct more distant targets.

FIG. 8A shows a detail of the mounting location of target 720 on the fore boom 130. FIG. 8B shows two antenna panels 105. Each antenna panel, except the panels nearest to the spacecraft bus structure, have 4 targets mounted in the positions shown. The two panels nearest to the spacecraft (not shown) bus structure only have two targets mounted. The mounting positions for the targets for the nearer panel are arranged so as avoid a nearer target obstructing the view to a further target when viewed from the optical assembly. This is illustrated in FIG. 9 with optical paths shown in dashed lines. Targets are mounted sufficiently above the surface of the antenna panel or boom so that they remain visible when the antenna wing or boom distorts or oscillates. FIG. 8C shows an example target 800. Targets may be folded against the panel when the panels are stowed prior to launch and may deploy using a simple spring or other means after the panels are deployed.

Figure 10:
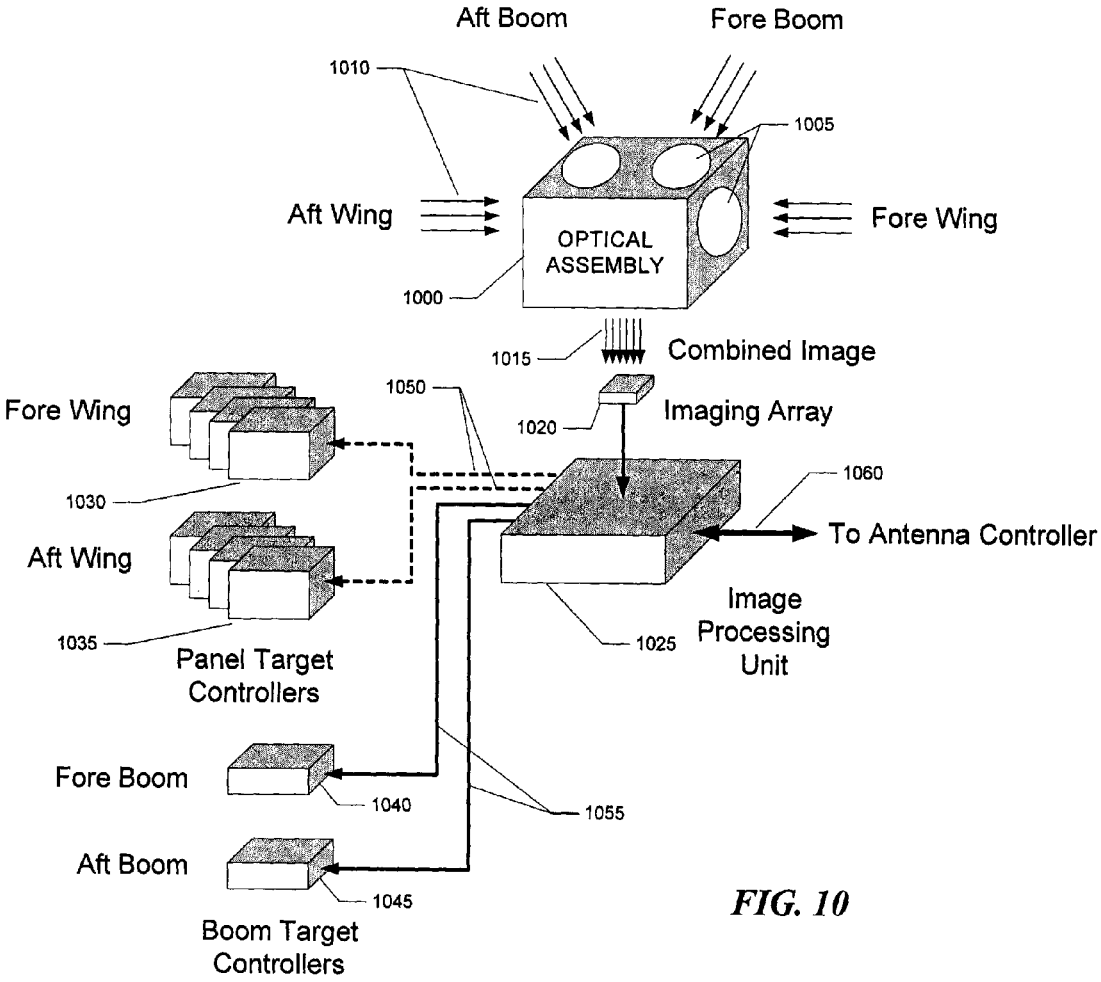
FIG. 10 shows components of the geometry compensation system. Geometry compensation is used to adjust phase settings of antenna elements to compensate for mechanical distortions in the antenna.

FIG. 10 shows the optical and electronic components of the geometry compensation system. Optical assembly 1000 receives light 1010 from the fore and aft booms and the fore and aft wings. The optical assembly combines the light from the four apertures so as to form a single, combined image 1015 that is projected onto the imaging surface of a solid state, two dimensional imaging array 1020. The output of the imaging array is received, processed and interpreted by computer based image processing unit 1025. Boom target controllers 1040 and 1045 control the illumination of the targets on the fore and aft booms respectively. Panel target controllers 1030 and 1035, located on each antenna panel of the fore wing and aft wing respectively, control the illumination of the panel targets.

Control signals 1055 for the boom target controllers are provided by a wired connection from image processing unit 1025. Control signals 1050 for the panel target controllers are provided by a control signal initiated by image processing unit 1025 and transmitted to each panel target controller using a CAN Bus signal. Alternatively, a coded infrared signal generated by the image processing unit 1025 and directed to and received by the panel target controllers could be used to affect this control function.

Operation of the geometry compensation system is described below.

Operation

The description above describes the operation of the individual elements of the active phased array antenna system. Here we will describe the overall operation of the system, using as an example a typical spaceborne radar application, such as a synthetic aperture radar that is used for making images for observation of the earth's surface.

Figure 11B:
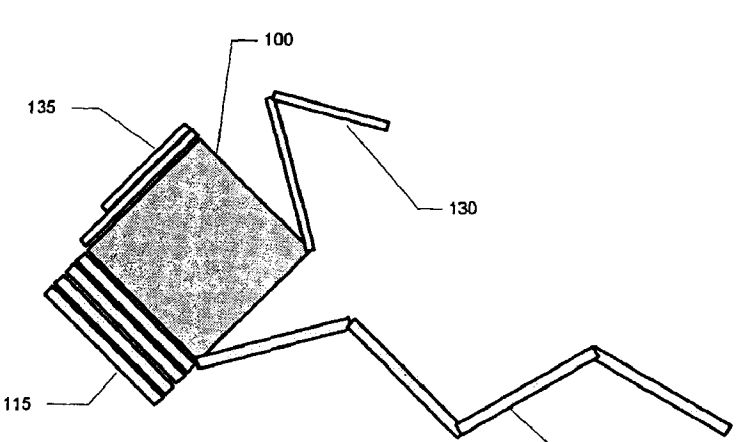
FIG. 11B shows the spacecraft during deployment of one antenna wing and boom.
Figure 11A:
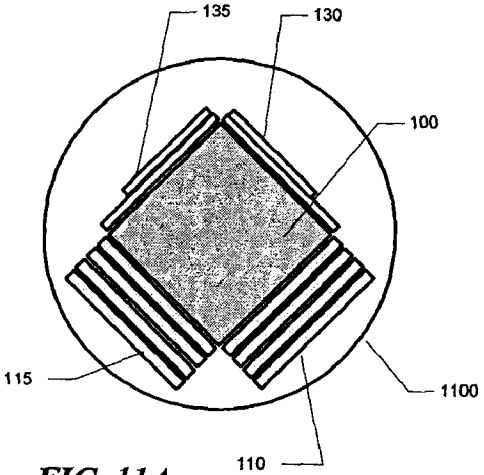
FIG. 11A shows the spacecraft with the antenna panels and booms stowed for launch.

Prior to launch, the spacecraft is placed in its launch configuration. FIG. 11A shows the spacecraft with the fore and aft booms 130, 135 and fore and aft wing 110, 115 antenna panels in their stowed position, inside the launch vehicle's payload fairing 1100.

Figure 11C:
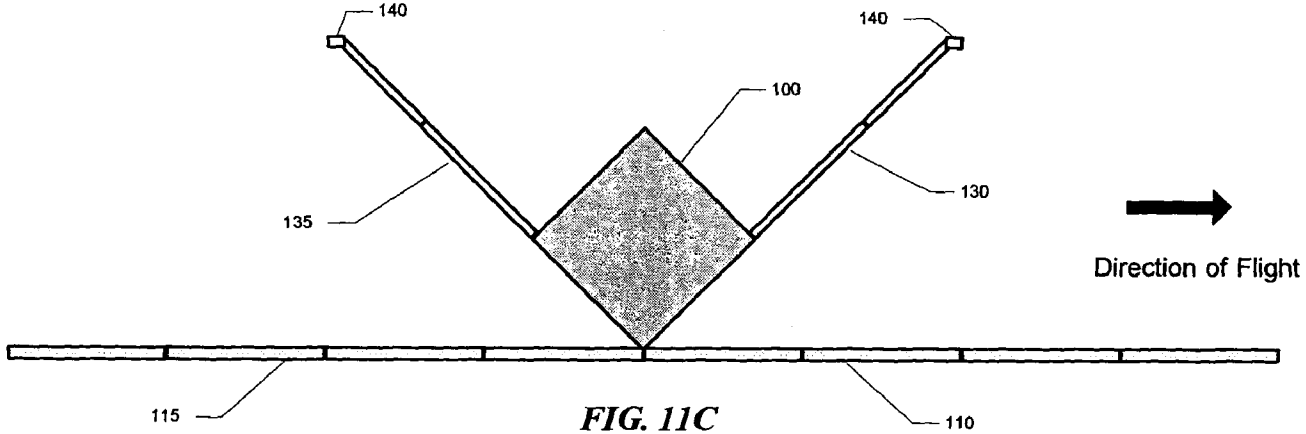
FIG. 11C shows the spacecraft in its operational configuration with both wings and booms deployed.

After launch and initial checkout, the wings and booms are deployed into their operational configurations. FIG. 11B shows the spacecraft on orbit with the fore boom 130 and the fore wing 110 partially deployed. FIG. 11C shows the spacecraft in its fully deployed, operational configuration.

In the example application, and typical of other applications as well, the radar is operated intermittently, being active (collecting image data in this example) over areas of interest and remaining inactive at other times.

To conserve power, the active phased array antenna system is placed into a standby state with its internal units either switched off completely, or put into a low power state that allows them to respond to commands. In this state, the spacecraft will generally be slewed to an attitude that improves the efficiency of solar power generation.

The circuits of the units that comprise the receiver/exciter 210 are powered off, except for those elements to respond to signals on control bus 260 that instruct the units to power up and become active.

A similar approach is used for the phased array antenna. As there are many active antenna nodes in the antenna, each node is designed to consume a minimum of power when not in use. This standby state is achieved by powering down all circuits within the node, except for the battery charging and power supply circuits and the microcontroller. The microcontroller is placed into a very low power standby state that will allow it to respond to a wakeup signal sent to it via the CAN Bus interface.

To make understanding of the overall operation easier, the operation of an active antenna node will be described first.

Figure 13:
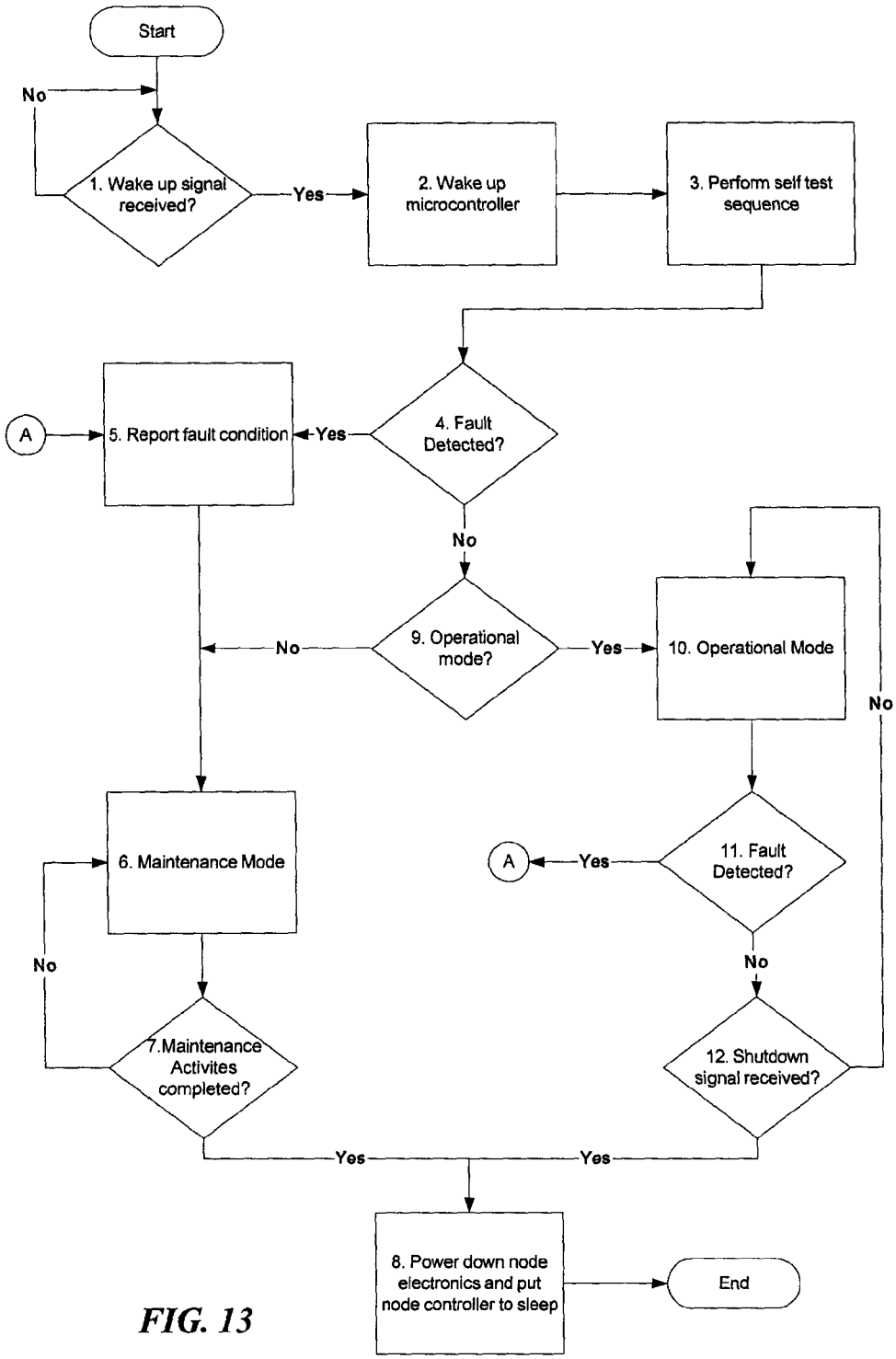
FIG. 13 shows a sequence of operations for the active antenna node.

FIG. 13 shows the sequence of events to bring an active antenna node from the inactive state to the operational state. The figure illustrates one embodiment, and alternative approaches and sequences can also be used to accomplish a similar purpose. It is assumed that the node is in the standby state described above at the start of the sequence.

The microcontroller circuits monitor the CAN Bus for a wakeup signal (step 1). When the wakeup signal is received, microcontroller clocks are enabled and it exits the standby mode and resumes execution of its software programs (step 2). The microcontroller then begins execution of a self-test sequence that verifies correct operation of the microcontroller itself, and powers up the remaining circuits in the node and determines their operating condition. Temperatures and voltages are also measured to determine if they are within the acceptable range.

If a significant fault is detected, then the fault is reported to antenna controller 270 (step 5) and the node enters a maintenance mode (step 6). The maintenance mode puts the node into a safe state and permits further diagnostic testing and the uploading of instructions or software patches to correct the fault. A command on the CAN Bus interface from the antenna controller causes the microcontroller to exit maintenance mode (step 7). The microcontroller then returns the node to its low power standby state (step 8).

If no faults are detected, then the node waits for a command to put it into operational mode (step 9). If this command is not received within a specified period of time, the node will enter maintenance mode. If the command is received, the node enters operational mode (Step 10). In operational mode, the node responds to control and timing messages from the antenna controller and processes the transmitted and received radar signals. Further detail is provided in the discussion on FIG. 14 below.

During operational mode, the microcontroller monitors node operation to detect any faults or non-nominal conditions such as a temperature that is too high (step 10). If a fault is detected, the node exits operational mode (step 11), reports the fault condition (step 5) and enters maintenance mode (step 6). Operation in maintenance mode is as previously described.

If no fault was detected while in operational mode, the microcontroller determines if a shutdown signal has been received from the antenna controller (step 12). If no shutdown signal has been received, operational mode continues. If a shutdown signal has been received, the microcontroller returns the node to its low power standby state (step 8) and the radar operation session is complete at the node.

Figure 14:
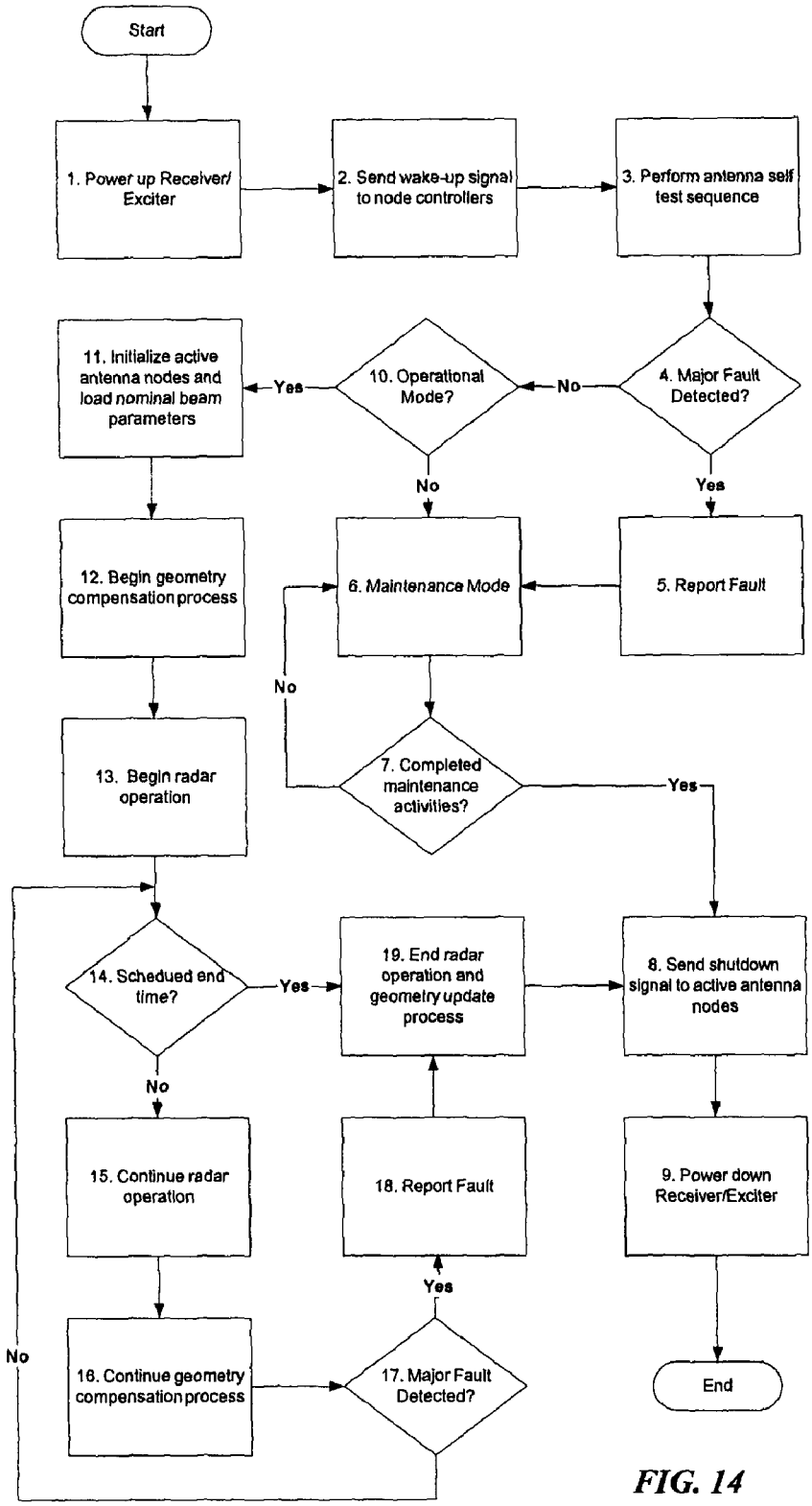
FIG. 14 shows an overall sequence of operations for an active phased array antenna.

FIG. 14 shows the overall operation of the phased array antenna system. It is assumed that the system is in the standby state at the start of the sequence.

Operation of the radar is scheduled to occur at specific times when the spacecraft is in the correct position in its orbit for the desired imaging operation. The scheduling is accomplished by using time-tagged commands issued from the spacecraft control center on the ground. Shortly before the scheduled start time of an image take, the receiver/exciter 210 hardware located in the spacecraft bus is powered up (step 1). The antenna controller 270 sends a wake up signal to the active antenna nodes (step 2). The active antenna nodes begin to execute their start-up sequence and self-test activities as described above.

The antenna controller begins a self-test sequence for the entire phased array antenna system, verifying correct operation of all units mounted in the bus structure and receiving status from the active antenna nodes (step 3). If a major fault is detected (step 4), the antenna controller reports the fault in antenna telemetry (step 5) and the antenna enters maintenance mode (step 6). The maintenance mode puts the antenna system into a safe state and permits further diagnostic testing and the uploading of instructions or software patches to correct the fault. When maintenance activities are completed, the antenna controller exits maintenance mode (step 7). A shutdown signal is sent to the active antenna nodes (step 8) and the receiver/exciter is powered down and returned to its standby state (step 9).

If no fault is detected, then the antenna controller determines if the scheduled activity for the antenna is a maintenance activity or an operational activity (step 10). If it is a maintenance activity, then maintenance mode is entered (step 6). If not a maintenance activity, the antenna begins its nominal operation.

The first step of nominal operations is to initialize the active antenna nodes with beam parameters and other operational parameters, for example transmit and receive window timing and duration, required for this image (step 11). The geometry compensation process is started to measure the geometry of the antenna and determine the phase and amplitude compensation for each active antenna node (step 12). The operation of the geometry compensation process is described below.

At the scheduled imaging time, the active phased array antenna begins to operate (step 13). The operation is controlled by timing and control messages 1400 broadcast on the CAN Bus to all active antenna nodes by the antenna controller 270. The messages are sent at a transmit pulse repetition frequency.

Figure 15:
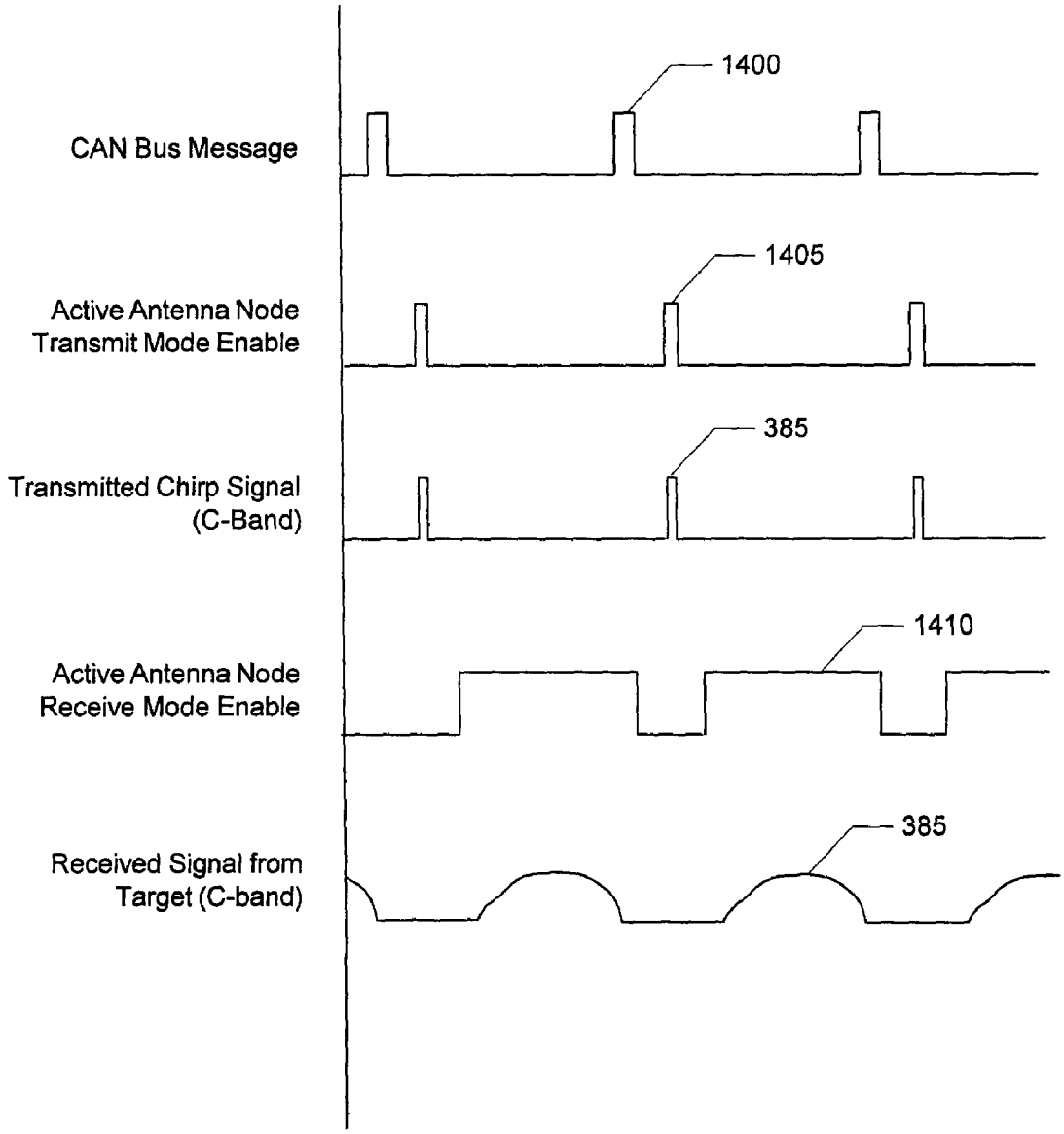
FIG. 15 shows a timing relationship between active antenna node control signals and signals transmitted and received from the active phased array antenna.

FIG. 15 shows an example of timing relationships. The CAN Bus timing and control message is sent shortly before the next transmit pulse. The message defines a timing reference point for the next pulse cycle. The active antenna node microcontroller uses the received timing and control message to establish two timing windows, a transmit timing window represented by the transmit mode enable 1405, and a receive timing window represented by the receive mode enable 1410.

These windows are made slightly larger than required to allow for timing jitter in the CAN Bus messages. Precise timing for the transmitted pulse is established by the transmit pulse generator 220.

Operation continues (steps 15 and 16) until either the scheduled end time is reached (step 14) or a major fault is detected (step 17).

In the case of reaching the scheduled end time, the radar operations and geometry compensation processes are terminated (step 19). A shutdown signal is sent to the active antenna nodes to return them to their standby state. Components within the receiver/exciter are also powered to conserve battery power (step 9).

In the case that a fault is detected, the fault is reported in the antenna telemetry (step 18), the radar operation and geometry compensation processes are terminated (step 19) and the antenna system powered down and returned to its standby state (steps 8 and 9).

Figure 16:
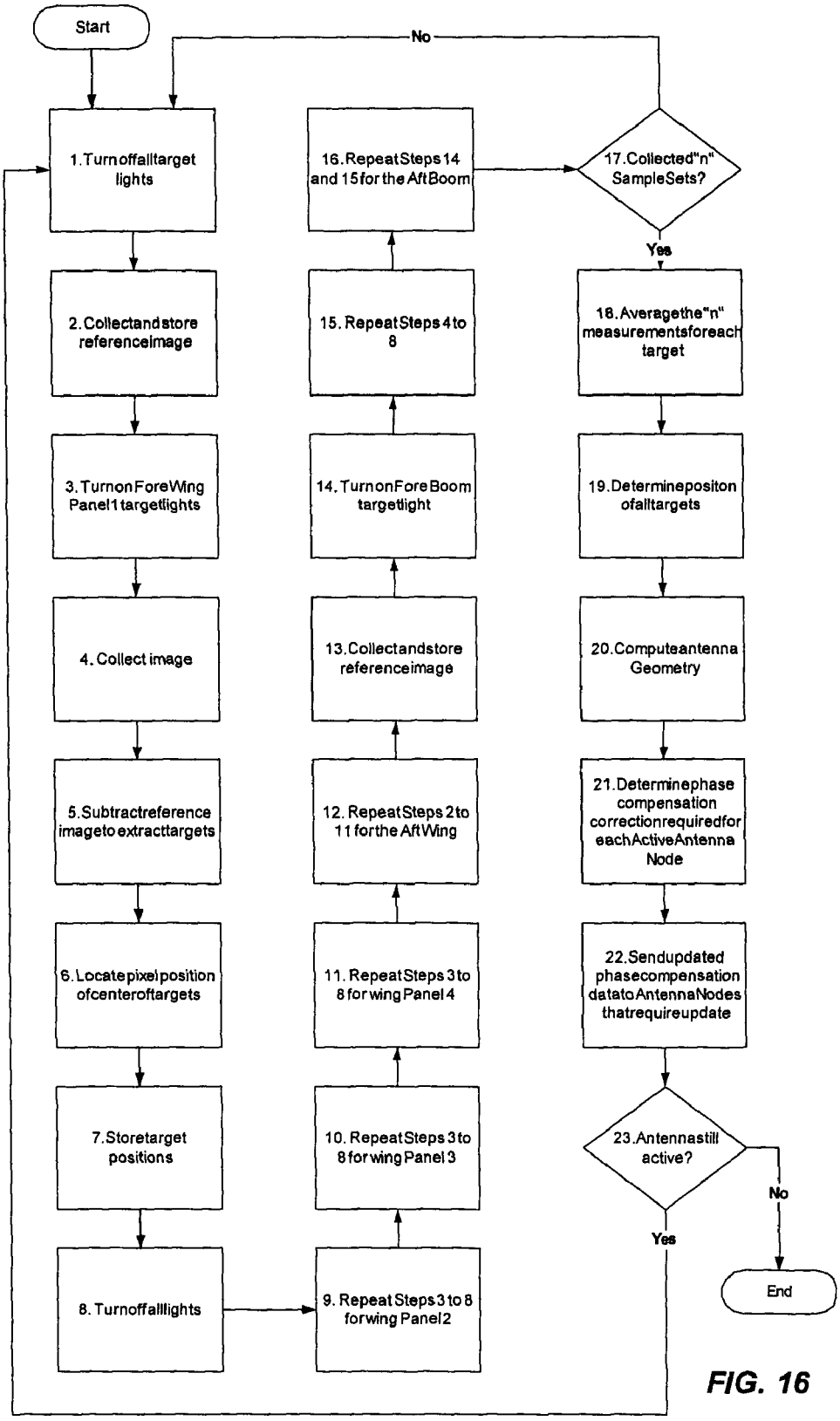
FIG. 16 shows a sequence of operations for performing geometry compensation.

FIG. 16 shows the sequence of operations for performing geometry compensation and describes how the geometry compensation system operates. Other sequences that collect reference images more or less frequently or collect images of the targets in a different order are possible, but the overall concept remains the same.

The geometry compensation operation is initiated whenever the active phased array antenna is active. The lights of all targets 715, 720 and 725 are switched off (step 1) and a reference image is captured and stored (step 2). The reference image consists of the superimposed images of the fore and aft booms and the fore and aft wings. Lighting conditions of the booms and wings is not critical. The fore wing panel 1 lights are switched on (step 3) and an image is collected (step 4). This image also consists of the superimposed images of the fore and aft booms and the fore and aft wings, however the targets on one panel are now illuminated. Note that the specific panel designated as panel 1 is not important, as all panels will be imaged during each cycle.

The reference image of step 2 is subtracted from the image of step 4 (step 5). Since the nominal position of the target is known, only the region of the image around the nominal target position needs to be processed. As the images are taken fractions of a second apart, the differences in the two images will be due solely to the illumination of the targets on fore wing panel 1. The resulting image will contain only the illuminated targets, effectively extracting the targets from the images. The targets are identified based on their relative position and the position of each target in the image is determined by applying an algorithm to locate the centroid of each target (step 6) and computing the two dimensional location. The third dimension is fixed and can be obtained by on-ground measurements prior to launch. The resulting 3-dimensional positions of the targets are stored (step 7).

The lights on panel 1 are turned off (step 8) and the process of determining the target positions is repeated for panel 2 (step 9). Similarly panel 3 (step 10) and panel 4 (step 11) measurements are taken. The process of collecting a reference image, turning on the lamps for each panel in turn and determining the target positions is repeated for the four panels of the aft wing (step 12).

A new reference image is collected and stored (step 13). The target on the fore boom is illuminated (step 14) and the position of the fore boom target is determined (step 15). Similarly the position of the aft boom target is determined (step 16). To reduce noise in the measurements and improve the overall accuracy, several measurements are taken (step 17) and averaged (step 18) to produce a final position determination for each target (step 19).

Using these position measurements a geometric model of the antenna is constructed (step 20). This model is used to compute the phase errors introduced by mechanical distortions and oscillations in the antenna at each active antenna node position and the phase correction required to compensate for these errors (step 21). For each active antenna node, the latest computed phase compensation value is compared to the previously computed value for that node to determine which nodes require updated correction information. The updated correction information is transmitted to those nodes that require it using the CAN Bus interface (step 22).

This process of measuring and updating phase compensation of the antenna nodes operates continuously as long as the antenna is active (step 23).

DESCRIPTION AND OPERATION OF ADDITIONAL EMBODIMENTS

Figure 12A:
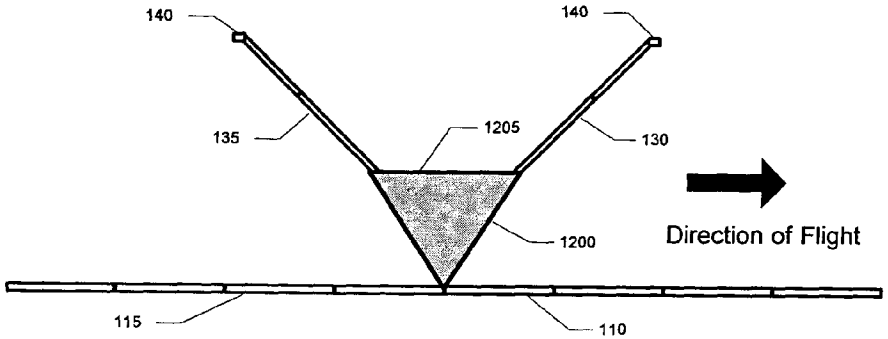
FIG. 12A shows an alternative bus structure configuration.
Figure 12B:
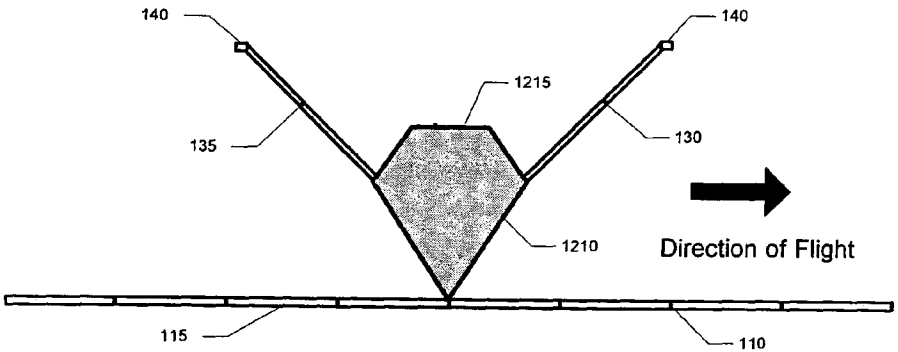
FIG. 12B shows another alternative bus structure configuration.
Figure 12C:
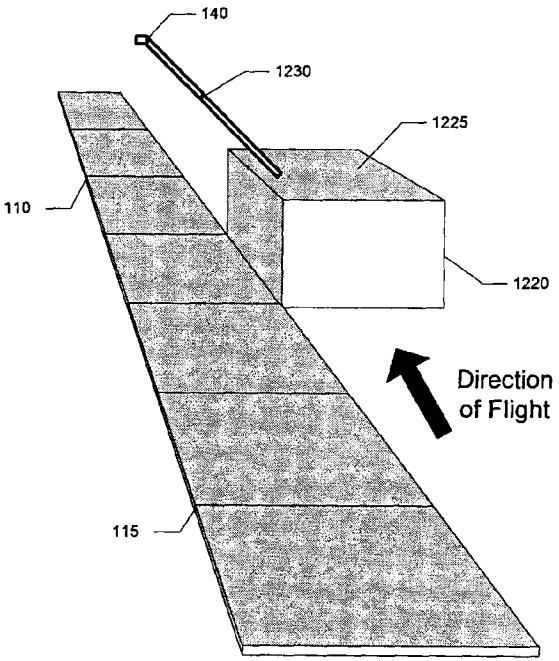
FIG. 12C shows another alternative bus structure configuration.

The depicted embodiment uses a square cross-section spacecraft bus structure 100. Different cross sections can be used and may have advantages in certain applications. Three examples of different configurations are given. FIG. 12A shows a triangular bus structure 1200 with the solar arrays used to provide bus power mounted on the surface 1205. FIG. 12B shows a variation of the triangular shape that provides more internal volume within the bus structure 1210. Solar cells to provide bus power may be mounted on surface 1215. FIG. 12C shows an alternate arrangement in which the phased array antenna is mounted outboard of the bus structure 1220. In this arrangement only a single boom assembly 1230 is required. Solar cells to provide bus power are mounted on surface 1225.

One embodiment of the invention produces a radar that operates with the same polarization in both transmit and receive, for example vertical polarization on transmit and vertical polarization on receive. The present system can be implemented to provide a radar capable of operating with selective polarization for transmitted signals, and dual polarizations for received signals. For example, transmit signals can be selected to be either horizontal polarization or vertical polarization, and receive signals can be selected to be horizontal polarization, vertical polarization, or both polarizations simultaneously. A quad-polarization radar can thus be achieved by transmitting horizontal and vertical polarizations on alternate transmit pulses, and simultaneously receiving both horizontal and vertical polarizations on for all pulses.

The basic concepts and characteristics described in the above embodiment remain, however some modifications may be employed to support the additional polarization, such as a different arrangement for the subarray in the active antenna node. Although a slotted waveguide arrangement can be constructed for dual polarization, it may have the disadvantage of resulting in a thicker antenna panel, increasing the mass and makes the stowing and deployment more difficult. Instead of a slotted waveguide subarray, a thin subarray assembly 1720 consisting of multiple patch radiators bonded to the front surface of the antenna panel. Each patch radiator element is driven by two feed assemblies, one for the horizontal polarization 1716 and the other for the vertical polarization 1718. The mechanical construction of the antenna panel is simplified by eliminating the conductive cavities under the slotted waveguide.

On the transmit side, a means is provided to select which of the two feeds is driven on a pulse by pulse basis, with the control signals generated by the microcontroller in the active antenna node. On the receive side, two receive channels are provided, both in the active antenna node and in the receiver/exciter.

Figure 17:
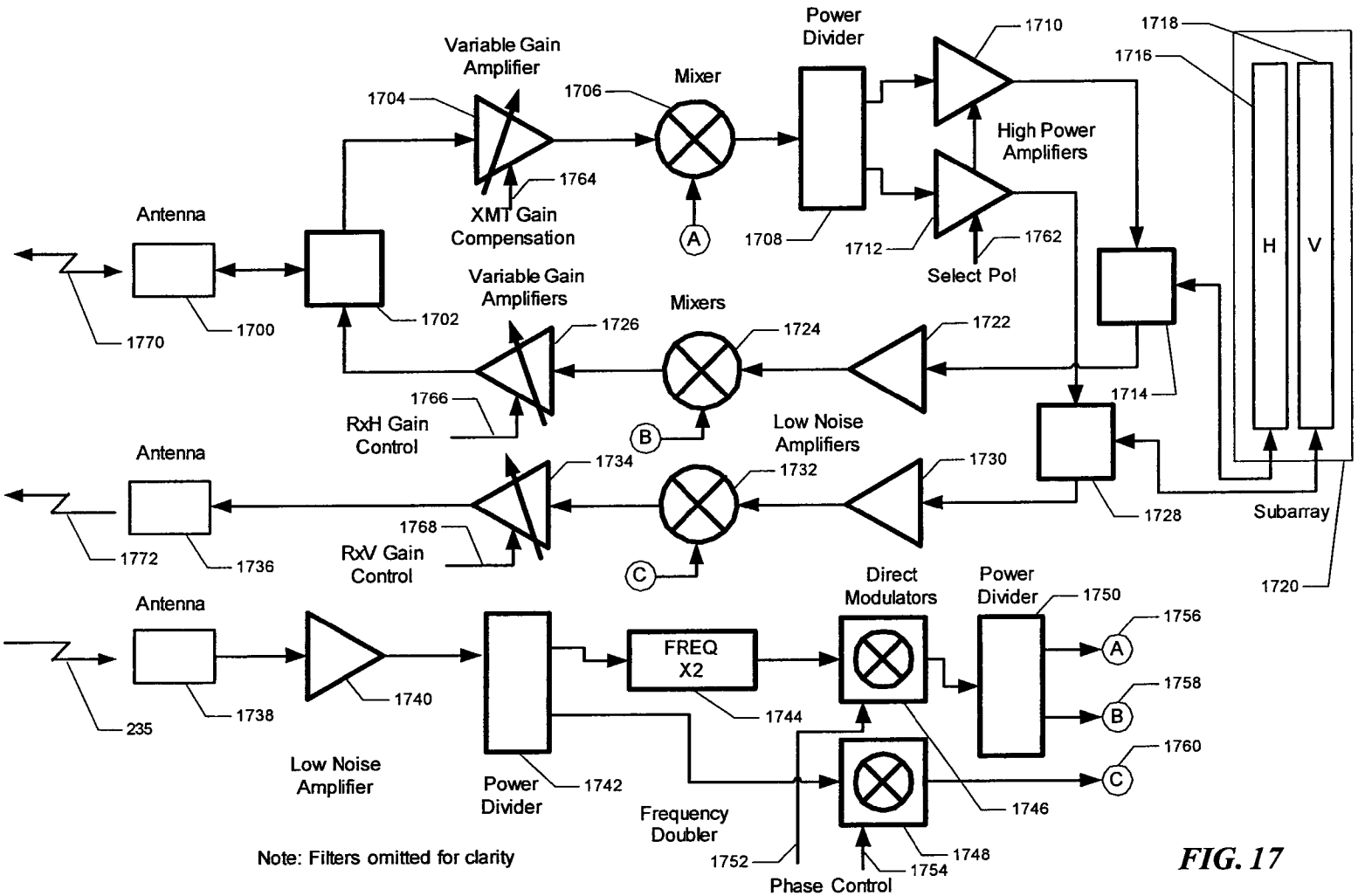
FIG. 17 shows a block diagram of the radio frequency circuit functions contained within the active antenna node for an active phased array antenna with multiple polarization capability.

FIG. 17 shows a block diagram of the radio frequency circuit functions contained within the active antenna node for an active phased array antenna with multiple polarization capability. The frequency translated transmit pulse is received by antenna 1700 and directed to the transmitter circuits by signal routing device 1702. The received signal is first amplified by variable gain amplifier 1704 and then converted to the operating frequency of the radar by mixer 1706. The amplitude and phase are adjusted using gain control signal 1764 and phase control signal 1752. High power amplifiers 1710 and 1712 are selectively enabled to drive either the horizontal or vertical feed of the subarray respectively, by polarization select signal 1762. Signal routing devices 1714 and 1728 connect the transmit signal to the horizontal and vertical feed assemblies 1716 and 1718 respectively.

The reflected signal returned from the target is received by the patch radiators in the subarray and the horizontal and vertical polarizations are routed to the two separate receive channels by signal routing devices 1714 and 1728. The horizontal polarization is amplified by low noise amplifier 1722 and frequency converted and phase adjusted by mixer 1724. The signal is amplified by variable gain amplifier 1726, and routed by signal routing device 1702 to antenna 1700 for transmission to a boom antenna assembly 140. The amplitude and phase are adjusted using gain control signal 1766 and phase control signal 1752. The vertical polarization is similarly processed using signal routing device 1728, low noise amplifier 1730, mixer 1732 and variable gain amplifier 1734. Antenna 1736 is used to transmit the signal to the boom antenna assembly. The amplitude and phase are adjusted using gain control signal 1768 and phase control signal 1754.

Since a second receive frequency is to be simultaneously transmitted to the boom antenna assembly, the frequency plan for the space feed is to be extended. Extending the example presented earlier, a frequency plan for a typical multiple polarization SAR application would be as follows: SAR operating frequency of 5.400 GHz (C-band), stable local oscillator frequency of 2.400 GHz, carrier frequency for the frequency translated transmit chirp and horizontal received polarization signal 1770 of 10.200 GHz and carrier frequency for the frequency translated vertical received polarization signal 1772 of 7.8 GHz.

The broadcast stable local oscillator signal is received by antenna 1738, amplified by low noise amplifier 1740 and divided into two signals by power divider 1742. One output of the divider directly provides the reference frequency used for the received vertical polarization. The other output of the divider is doubled in frequency by frequency doubler 1744 to provide the reference frequency used for downconverting the frequency translated chirp and upconverting the received horizontal polarization. The phase of the reference frequencies is adjusted by direct modulators 1748 and 1746 based on control signals 1754 and 1752 respectively. Since transmit and receive do not occur simultaneously, direct modulator 1746 can be used to provide the phase adjusted reference frequency to both the transmitter and horizontal polarization receive circuits through power divider 1750. Phase control signal 1752 is adjusted during the pulse period to first produce the required phase for the transmit pulse and then the required phase for the received signal.

Other embodiments of a multiple polarization antenna are possible, however the basic principles remain the same.

The geometry compensation system can alternatively be implemented using passive targets whose surface is covered by highly directional reflective material. The targets are selectively illuminated by narrow beams of light projected from light sources located in the vicinity of the optical assembly. Light sources with a narrow spectral bandwidth and corresponding filters in the optical path are used. Operation is similar to that described for the targets with the built in light sources, except that the light sources in the bus structure are illuminated in sequence instead of the light sources in the targets. This approach simplifies the design of the targets and eliminates the need for control circuits and power sources for the targets on the antenna panels. The disadvantage is a more complicated optical assembly, because it is to incorporate the light sources close to the optical axis.

Antenna distortion can be decomposed into two components, a fixed distortion and a varying distortion. The fixed distortion can be measured and compensated for using a classic calibration approach traditionally used in such a system. For example, in a SAR system, a beam pattern can be measured over a well-selected target area and distortion can be determined and removed by applying phase compensation using the same phase shifters used to shape the beams. Compensating for the varying component involves making on-orbit measurements over the period that the antenna is in use and applying a dynamic compensation. Geometry compensation that takes advantage of this characteristic can also be used in place of an optically based compensation approach.

One alternative is to use ground processing of on-orbit measurements. A method for accomplishing this has been described by Luscombe et al (In orbit Characterisation of the RADARSAT-2 Antenna—Proceedings of the Committee on Earth Observation Standards—Working Group on Calibration and Validation—Synthetic Aperture Radar Workshop 2004). This technique uses a portion of the antenna as a reference to obtain data on relative geometric displacement of a different portion of the antenna (e.g. a row or column) that is being measured. The reference portion initially used is then measured by using a previously measured portion of the antenna as the reference. A complete set of measurements can be taken in a relatively short period of time (<2 seconds typically). In operation, a set of measurements is made immediately prior to and following the collection of data for an image. The measured results are transmitted to the ground and are post-processed to determine the antenna geometry present during the imaging operation. This geometry information is then used to compensate for antenna distortion during the processing of the image data.

Another alternative means of geometry compensation is to measure temperature at numerous points across the antenna as a means to determine the varying distortion. Classical techniques would be used to determine and compensate for the fixed distortion as described above. A calibration campaign would then be conducted to characterize the antenna distortion as a function of temperature. This calibration campaign would involve repeated measurements of antenna pattern over a well-selected target area. Temperature of the antenna prior to these measurements would be varied, for example by heating the antenna by re-orienting the spacecraft or by using the antenna for varying lengths of imaging prior to taking the measurement (thus dissipating more or less power from Transmit Receive modules into the antenna structure). On-ground analysis of the resulting antenna patterns would yield distortion compensation calibration data. Compensation of antenna distortion could then be applied either as a real time correction on the spacecraft (measure temperatures and apply corresponding phase correction at each point in the antenna) or as part of the on-ground processing of the SAR data.

In one embodiment of the antenna system, an active lens configuration is used. Because a lens configuration is intrinsically less sensitive to physical antenna distortion than a direct fed array or a reflector, it is particularly suited to either of the above alternative geometry compensation approaches.

The construction of the active phased array antenna for radar applications takes advantage of the antenna not needing to support simultaneous transmit and receive functions. However, the antenna can be adapted for uses in applications other than radar systems, for example, in a communications system, where simultaneous and continuous transmit and receive is required. The approach is to use two carrier frequencies, on each of the space feed and the active phased array antenna face, one frequency for the signal to be transmitted, and one for the received signal. The basic structure of the active antenna node remains unchanged. An example frequency plan is as follows: Communications link transmit operating frequency of 5.700 GHz, receive frequency of 5.100 GHz, stable local oscillator frequency of 2.400 GHz, carrier frequency for the frequency translated transmit signal of 10.5 GHZ, and frequency translated receive signal 9.900 GHz.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description using the singular or plural number may also include the plural or singular number respectively. The word "or," in reference to a list of two or more items, covers all of the following interpretations of the word: any of the items in the list, all of the items in the list, and any combination of the items in the list.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while processes or blocks are presented in a given order, alternative embodiments may perform routines having steps, or employ systems having blocks, in a different order, and some processes or blocks may be deleted, moved, added, subdivided, combined, and/or modified to provide alternative or subcombinations. Each of these processes or blocks may be implemented in a variety of different ways. Also, while processes or blocks are at times shown as being performed in series, these processes or blocks may instead be performed in parallel, or may be performed at different times.

The teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

These and other changes can be made to the invention in light of the above Detailed Description. While the above description describes certain embodiments of the invention, and describes the best mode contemplated, no matter how detailed the above appears in text, the invention can be practiced in many ways. Details of the system may vary considerably in its implementation details, while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

We claim:

1. A space-based antenna system for a satellite, the system comprising:

a central system of the space-based antenna system, wherein the central system includes:

a stable local oscillator configured to generate a reference frequency signal, circuitry configured to generate transmit signals based at least in part on the reference frequency signal, at least one system transceiver for transmitting the reference frequency signal and the transmit signal, and to receive a receive signal; and, multiple active antenna nodes forming a portion of an active phased array antenna system, wherein each active antenna node includes:

at least one node transceiver configured to receive the reference frequency signal and the transmit signal from the system transceiver, and to transmit the receive signal to the system transceiver, frequency translating circuitry coupled to receive the reference frequency signal, and to provide signal translation between the transmit and receive signals to inhibit interference between the transmit and receive signals, a power generation portion, and control circuitry coupled with the node transceiver and the power generation portion, wherein the control circuitry is configured to process or control the transmit and receive signals, and configured to at least facilitate control of beam formation and beam steering of the space-based antenna system using, at least in part, the reference frequency signal and, one or both of the transmit and receive signal.

2. The system of claim 1 wherein the control circuitry employs timing signals local with respect to the node, and wherein the space-based antenna system employs phase control using a distributed reference frequency.

3. The system of claim 1, further comprising at least one antenna wing that retains at least some of the active antenna nodes, and an antenna distortion compensation system that includes:

multiple optical targets positioned on the antenna wing;

at least one image sensor for locating at least some of the multiple targets on the antenna wing and outputting an image signal; and a geometry compensation subsystem for processing the output image signal and generating a distortion compensation signal.

4. The system of claim 1, further comprising at least one antenna wing that retains at least some of the active antenna nodes, wherein the antenna wing includes a radiating panel portion on one side and solar cells on a reverse side, and provides both structural support and acts as an antenna.

5. The system of claim 1, further comprising stable local oscillator phase control circuitry coupled to the stable local oscillator for implementing a swept receive mode of the space-based antenna system, wherein the phase control circuitry is configured to adjust a received signal sweep phase to point the beam in elevation to receive signals at a near range edge at a start of the sweep, and at a far range edge at an end of the sweep.

6. An active phased array antenna system for a satellite, the system comprising:

a core system comprising:

at least one controller for generating transmit signals;

at least one transceiver for wirelessly transmitting a reference signal and the transmit signal from the core system to nodes, and for wirelessly receiving a receive signal from the nodes;

multiple nodes for generating an active phased array, wherein each node comprises:

at least one node transceiver configured for wirelessly receiving a reference signal and the transmit signal from the core system, for transmitting the transmit signals to a target, for receiving the receive signals from the target, and for wirelessly transmitting the receive signal to the core system, circuitry for inhibiting signal interference between the transmit and receive signals between the core system and node and between the node and the target; and at least one node control controller, coupled with the node transceiver and the circuitry for inhibiting signal interference, for controlling or processing the transmit and receive signals.

7. The system of claim 6, further comprising:

at each node, at least one power generator for generating power, and, wherein the node controller includes circuitry for facilitating beam formation and beam steering based at least in part on the transmit signal.

8. The system of claim 6, further comprising:

at least one oscillator, coupled to the controller, for generating a stable reference frequency signal, and wherein the transceiver is further configured for transmitting the reference frequency signal to the multiple nodes.

9. The system of claim 6, further comprising:

means for carrying some of the multiple nodes; and means, coupled to the controller, for determining a distortion of the means for carrying, and for generating at least one compensation signal based on the determined distortion.

10. In a space-based active lens radar system having at least one elongated planar portion, an apparatus comprising:

multiple nodes carried by the elongated planar portion and forming at least part of the space-based active lens radar system, wherein each node comprises:

a transmit portion configured to wirelessly receive a space fed signal from the radar system and to generate a transmit signal to be directed to a target as part of a transmit beam;

a receive portion configured to receive an echo signal from the target and to generate a receive signal to be wirelessly transmitted to the radar system;

a signal isolation portion, coupled to at least one of the transmit and receive portions, and configured to inhibit signal interference between the transmit signal and the receive signal;

a controller coupled among the transmit, receive and signal isolation portions; and, local power generation at each node for providing power to the controller and to the transmit, receive and signal isolation portions within the node.

11. The apparatus of claim 10 wherein a rear portion of the elongated planar portion carries the multiple nodes, and wherein a front portion of the elongated planar portion is configured to transmit at least a portion of the transmit beam and receive at least a portion of the echo signal.

12. The apparatus of claim 10 wherein the signal isolation portion is configured to inhibit signal interference between concurrent transmission of the transmit signal and the receive signal via: frequency translation, electromagnetic shielding, use of different signal polarizations, use of digital signal processing techniques, use of differently coded spread spectrum channels, or use of time domain multiplexing.

13. In a space-based active lens radar system having a central core portion and at least one elongated planar portion, an apparatus comprising:

multiple nodes carried by the elongated planar portion and forming at least part of the space-based active lens radar system, wherein each node comprises:

a transmit portion configured to wirelessly receive a space fed signal from the radar system and to generate a transmit signal to be directed to a target as part of a transmit beam;

a receive portion configured to receive an echo signal from the target and to generate a receive signal to be wirelessly transmitted to the radar system;

a signal isolation portion, coupled to at least one of the transmit and receive portions, and configured to inhibit signal interference between the transmit signal and the receive signal;

a controller coupled among the transmit, receive and signal isolation portions;

a frequency adjuster for adjusting a received reference signal and to produce a frequency adjusted signal, a modulator for producing a modulated signal based on the frequency adjusted signal, transmit and receive paths, each having a mixer for mixing in the modulated signal, and a signal selector for selectively providing the modulated signal to the transmit and receive paths.

14. The apparatus of claim 13 wherein a rear portion of the elongated planar portion carries the multiple nodes, and wherein a front portion of the elongated planar portion is configured to transmit at least a portion of the transmit beam and receive at least a portion of the echo signal.

15. The apparatus of claim 13 wherein the signal isolation portion is configured to inhibit signal interference between concurrent transmission of the transmit signal and the receive signal via: frequency translation, electromagnetic shielding, use of different signal polarizations, use of digital signal processing techniques, use of differently coded spread spectrum channels, or use of time domain multiplexing.

16. In a space-based active lens radar system having at least one wing, an apparatus comprising:

multiple nodes carried by the wing and forming at least part of the space-based active lens radar system, wherein each node comprises:

a signal processing portion configured to at least assist in directing a transmit signal to a target as part of a transmit beam, and to receive an echo signal from the target;

a node controller coupled to the signal processing portion; and, local power generation circuitry configured to locally provide power to the node controller and to the signal processing portion, without use of external power or external power distribution wiring from the radar system to the multiple nodes.

17. The apparatus of claim 16 wherein the local power generation circuitry includes a solar cell array, an energy storage device, and a regulator coupled between the solar cell array and the energy storage device.

* * * * *